US007134658B2

(12) United States Patent
Shimomura et al.

(10) Patent No.: US 7,134,658 B2
(45) Date of Patent: Nov. 14, 2006

(54) RECORDING APPARATUS HAVING SKEW REMOVAL

(75) Inventors: Masaki Shimomura, Nagano (JP); Kazuhisa Kawakami, Nagano (JP); Tsuyosi Yamanaka, Nagano (JP); Masafumi Furuyama, Nagano (JP); Toru Fukushima, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 124 days.

(21) Appl. No.: 10/230,374

(22) Filed: Aug. 29, 2002

(65) Prior Publication Data

US 2003/0132567 A1 Jul. 17, 2003

(30) Foreign Application Priority Data

Aug. 31, 2001 (JP) ..... P2001-265117

(51) Int. Cl.
*B65H 1/00* (2006.01)

(52) U.S. Cl. ..... 271/227; 271/242; 271/244; 271/127; 399/345; 400/579

(58) Field of Classification Search ..... 271/242, 271/244, 227, 127, 129; 399/345; 400/579
See application file for complete search history.

(56) References Cited

U.S. PATENT DOCUMENTS 4,779,861 A 10/1988 Ozawa et al.
5,415,387 A * 5/1995 Suzuki ..... 271/10.02
5,975,516 A * 11/1999 Maruchi et al. ..... 271/10.12
5,982,400 A * 11/1999 Yokoi et al. ..... 346/134
6,032,949 A * 3/2000 Ando ..... 271/225
6,142,467 A 11/2000 Funada
6,354,386 B1 * 3/2002 Ruttley ..... 175/328
2002/0117795 A1 8/2002 Lee et al.

FOREIGN PATENT DOCUMENTS

EP 0 733 566 A 9/1996
EP 0 733 566 A2 9/1996
JP 6 2259944 A 11/1987
JP 2001072255 A * 3/2001
JP 2001270203 10/2001
JP 2001270203 A * 10/2001

* cited by examiner

*Primary Examiner*—Patrick Mackey
(74) *Attorney, Agent, or Firm*—Sughrue Mion, PLLC

(57) ABSTRACT

A recording apparatus has a paper feeder wherein single sheets of paper can be set, a paper delivery device for transporting paper fed from the paper feeder to a recorder, and a control unit for controlling operation of the paper feeder and the paper delivery device. The control unit has a skew removal execution mode of only the first sheet of paper where the paper tip is bitten into a paper delivery roller forming a part of the paper delivery device and then the paper delivery roller is reversely rotated for ejecting the paper tip for the first sheet of paper at the start of recording and then forward rotating the paper delivery roller for delivering the sheet of paper whose skew is removed to the recorder and delivering the second and later sheets of paper to a record area without executing the skew removal.

4 Claims, 21 Drawing Sheets

RECORDING APPARATUS HAVING SKEW REMOVAL

The present application is based on Japanese Patent Application No. 2001-265117, which is incorporated herein by reference.

DETAILED DESCRIPTION OF THE INVENTION

1. Field of the Invention

This invention relates to a recording apparatus comprising a paper feeder for stacking a plurality of record materials and feeding them downstream one at a time from the top record material.

2. Related Art

A printer is available as one of recording apparatus and some printers comprise a paper feeder for feeding print paper as record material downstream one sheet at a time. Further, such a paper feeder comprises a paper feed roller which is rotated and a hopper made of a plate-like body long in the width direction of print paper, placed in an inclined attitude with the paper feed passage of print paper as a side view, comprising a rotation support point in an upper part, and rotated, thereby being brought away from and pressed against the paper feed roller, and pushes up stacked sheets of print paper by the hopper, thereby feeding print paper one sheet at a time from the top sheet.

The hopper is urged by an urging device and is rotated in a direction in which it is pressed against the paper feed roller, whereby stacked print paper is pressed against the paper feed roller. The hopper comprises a release device and is rotated in a direction in which it is brought away from the paper feed roller, and is held by the release device. Thus, the hopper is displaced between the paper feed position for pressing the top sheet of print paper against the paper feed roller (paper feed state) and the standby position at which the hopper is most away from the paper feed roller (release state). The paper feed position changes depending on the number of set (stacked) sheets of print paper.

By the way, when the hopper is displaced from the standby position to the paper feed position, it is rotated vigorously in the direction in which the hopper is pressed against the paper feed roller by the urging force of the urging device and therefore print paper collides with the paper feed roller and thus there is a problem of producing large-noise (collision noise) from the components in the surroundings of the hopper and the paper feed roller.

The rotation angle (swing angle) of the hopper to displace the hopper from the standby position to the paper feed position changes depending on the number of set (stacked) sheets of print paper as described above. That is, the larger the number of sheets of print paper, the smaller the swing angle; the smaller the number of sheets of print paper, the larger the swing angle. Therefore, if the number of set sheets of paper is small, the swing angle of the hopper becomes large and thus it takes time in the paper feed operation and paper cannot be repeatedly fed at high speed; this is a problem.

SUMMARY OF THE INVENTION

It is therefore an object of the invention to decrease noise occurring when a hopper is swung and make it possible to perform high-speed paper feed operation.

(1) According to the invention, there is provided a recording apparatus comprising:

a paper feeder configured to set a plurality of single sheets of paper therein;

a paper delivery device having a paper delivery roller for transporting a sheet of paper fed from said paper feeder to a recorder; and a control unit for controlling operation of said paper feeder and said paper delivery device;

wherein said paper feeder and paper delivery device are configured to conduct a skew removal that a paper tip of a sheet of paper fed from said paper feeder is once bitten into the paper delivery roller and then ejected therefrom by reversely rotating said paper delivery roller before delivering the sheet of paper to the recorder by forwardly rotating the paper delivery roller; and said control unit comprises a skew removal execution mode of only the first sheet of paper where the skew removal is executed only to a paper tip of a first sheet of paper which is firstly fed by the paper feeder at a start of recording operation of the apparatus and later sheets of paper are delivered to the recorder without executing the skew removal.

To execute one job for recording on a plurality of sheets of paper set (stacked) in the paper feeder, the paper is fed in the order of the first sheet, the second sheet, the third sheet . . . and further a predetermined amount of start locating control is performed in the paper delivery device and then the paper is delivered to the recorder for recording on the paper. At the time, the first sheet of paper is fed from the nonoperating state (incomplete warming-up state) in which paper is placed in the standby state in the paper feeder and on the other hand, the second and later sheets of paper are fed from the operation continuation state (complete warm-up state) just after the paper feeder once performs the paper feed operation. There is a tendency of easy occurrence of a problem of paper feed (delivery) accuracy degradation such that the paper tip position accuracy of the first sheet of paper is degraded more easily than that of the second or later sheet of paper because of the difference.

According to the above (1), the skew removal is performed only for the first sheet of paper whose feed (delivery) accuracy is easily degraded, so that the predetermined amount of start locating control, etc., can be accomplished with high accuracy and degradation of paper feed accuracy can be prevented easily. Moreover, the skew removal is not performed for the second or later sheet of paper whose feed (delivery) accuracy is hard to degrade, so that the paper feed accuracy can be secured and the throughput can be enhanced in all process of one job from record start to end.

(2) The invention is further characterized by the feature that in the recording apparatus of (1), said paper feeder includes a paper feed roller for feeding one of the sheets of paper by rotating and a hopper for pushing up and pressing the sheets of paper against the paper feed roller, and the hopper is configured to push up the first sheet of paper at the start of recording operation at a first stroke and to push up the later sheets of paper at a second stroke which is smaller than the first stroke.

With the hopper configured so as to push up the first sheet of paper at the start of recording at a large stroke and push up the second and later sheets of paper at a smaller stroke than the large stroke, particularly the paper feed (delivery) accuracy of the first sheet of paper is easily degraded and thus the invention is applied and the advantage is noticeable.

As a specific structure example of the large stroke and the smaller stroke, the following configuration is possible: Release device for bringing the hopper away from the paper feed roller comprises the three hopper control modes: A non-release mode, a large release mode, and a small release mode positioned therebetween.

In the non-release mode, the release device does not give any external force to the hopper and allows the record material to be pressed against the paper feed roller by the urging force of urging device. That is, in the non-release mode, the hopper is at the paper feed position (in the paper feed state).

Next, in the large release mode, the hopper is rotated so that it is brought most away from the paper feed roller, and is held in this state. That is, in the large release mode, the hopper is at complete standby position (release state) and in the state, it is made possible to set record material.

The paper feeder comprises the small release mode in which the hopper position is between the non-release mode and the large release mode. That is, in the small release mode, the hopper is rotated and is held so that the top record material is brought a little away from the paper feed roller. Therefore, when the hopper is rotated for the paper feed operation of the next record material from the state, the rotation angle (swing angle) of the hopper to press the record material against the paper feed roller can be minimized. For example, if the small release mode is executed when the paper feed job is followed by another paper feed job, it is made possible to decrease noise occurring when the record material is pressed against the paper feed roller, and execute the high-speed paper feed operation (repeated paper feed).

(3) According to the invention, there is provided a recording apparatus comprising:

a paper feeder configured to set a plurality of single sheets of paper therein;

a paper delivery device having a paper delivery roller for transporting a sheet of paper fed from said paper feeder to a recorder; and a control unit for controlling operation of said paper feeder and said paper delivery device;

wherein said paper feeder and paper delivery device are configured to conduct a skew removal that a paper tip of a sheet of paper fed by said paper feeder is once bitten into the paper delivery roller and then ejected therefrom by reversely rotating said paper delivery roller before delivering the sheet of paper to the recorder by forwardly rotating the paper delivery roller; and said control unit comprises a skew removal mode where the skew removal is executed to a sheet of paper whose margin dimension in data to execute recording is smaller than a reference value and a skew removal suppression mode where a sheet of paper whose margin dimension is larger than the reference value is delivered to the recorder without executing the skew removal.

To print up to the margin of paper, if a skew exists, it is conspicuous; on the other hand, in printing on paper with a comparatively large margin, if a small skew exists, it is hard to be conspicuous. According to the invention, only when printing up to the margin of paper, the skew removal mode is applied and in printing on paper with a comparatively large margin, the skew removal suppression mode is applied, so that in printing on paper with a comparatively large margin, enhancement of throughput can take precedence over.

(4) According to the invention, there is provided a recording apparatus comprising:

a paper feeder configured to set a plurality of single sheets of paper therein;

a paper delivery device having a paper delivery roller for transporting a sheet of paper fed from said paper feeder to a recorder; and a control unit for controlling operation of said paper feeder and said paper delivery device;

wherein said paper feeder and paper delivery device are configured to conduct a skew removal that a paper tip of a sheet of paper fed by said paper feeder is once bitten into the paper delivery roller and then ejected therefrom by reversely rotating said paper delivery roller before delivering the sheet of paper to the recorder by forwardly rotating the paper delivery roller; and said control unit comprises a skew removal mode where the skew removal is executed to a sheet of paper whose image data amount in data to execute recording is larger than a reference value and a skew removal suppression mode where a sheet of paper whose image data amount is smaller than the reference value is delivered to the recorder without executing the skew removal.

According to the invention, the control unit comprises the skew removal mode for executing skew removal and then delivering the paper to the recorder when the image (print) data amount in data to execute recording is larger than the reference value and the skew removal suppression mode for delivering the paper to the recorder without executing skew removal when the image data amount is smaller than the reference value, so that when the amount of image data with a skew hard to be conspicuous is small, throughput can be enhanced.

(5) According to the invention, there is provided a recording apparatus comprising:

a paper feeder configured to set a plurality of single sheets of paper therein, including a paper feed roller for feeding one of the sheets of paper by rotating and a hopper for pushing up and pressing the sheets of paper against the paper feed roller;

a paper delivery device having a paper delivery roller for transporting a sheet of paper fed from said paper feeder to a recorder; and a control unit for controlling operation of said paper feeder and said paper delivery device;

wherein the hopper is configured to push up the first sheet of paper at the start of recording operation at a first stroke and to push up the later sheets of paper at a second stroke which is smaller than the first stroke; and said control unit comprises a speed change mode where a first hopper pushing-up speed when the first stroke is applied is set lower than a second pushing-up speed when the second stroke is applied.

When the large stroke is applied, the hopper swing distance is large and thus noise when paper is pressed against the paper feed roller becomes easily large. However, according to the invention, the control unit comprises the speed change mode for setting the hopper pushing-up speed when the large stroke is applied lower than the pushing-up speed when the smaller stroke is applied, so that the noise problem can be solved efficiently and the whole throughput of one print job can be enhanced.

(6) According to the invention, there is provided a recording apparatus comprising:

a paper feeder configured to set a plurality of single sheets of paper therein;

a paper delivery device for transporting paper fed from said paper feeder to a recorder; and a control unit for controlling operation of said paper feeder and said paper delivery device;

wherein said control unit comprises two or more of the modes in the recording apparatus according to any of (1) to (5).

According to the invention, the optimum paper feed mode can be selected for execution in one print job for different types of paper and different-size paper.

BRIEF DESCRIPTION OF THE DRAWINGS

The above and other objects, features and advantages of the present invention will become more apparent from the following description of the presently preferred exemplary embodiments of the invention taken in conjunction with the accompanying drawings, in which:

FIG. 15A shows the positional relationship between the paper feed roller and the hopper and FIG. 15B shows the engagement state of the cam lever and the rotary cam;

FIG. 16A shows the positional relationship between the paper feed roller and the hopper and FIG. 16B shows the engagement state of the cam lever and the rotary cam;

FIG. 17A shows the positional relationship between the paper feed roller and the hopper and FIG. 17B shows the engagement state of the cam lever and the rotary cam;

FIG. 18A shows the positional relationship between the paper feed roller and the hopper and FIG. 18B shows the engagement state of the cam lever and the rotary cam;

FIG. 19A shows the positional relationship between the paper feed roller and the hopper and FIG. 19B shows the engagement state of the cam lever and the rotary cam;

FIG. 20A shows the positional relationship between the paper feed roller and the hopper and FIG. 20B shows the engagement state of the cam lever and the rotary cam;

FIG. 21A shows the positional relationship between the paper feed roller and the hopper and FIG. 21B shows the engagement state of the cam lever and the rotary cam; FIG. 22A shows the positional relationship between the paper feed roller and the hopper and FIG. 22B shows the engagement state of the cam lever and; the rotary cam.

DETAILED DESCRIPTION OF THE PREFERRED EMBODIMENTS

Referring now to the accompanying drawings, there is shown a preferred embodiment of the invention in the order of "General configuration of ink jet printer," "General configuration of paper feeder," and "Configuration of hopper release device."

<General Configuration of Inkjet Printer>

Figure 1:
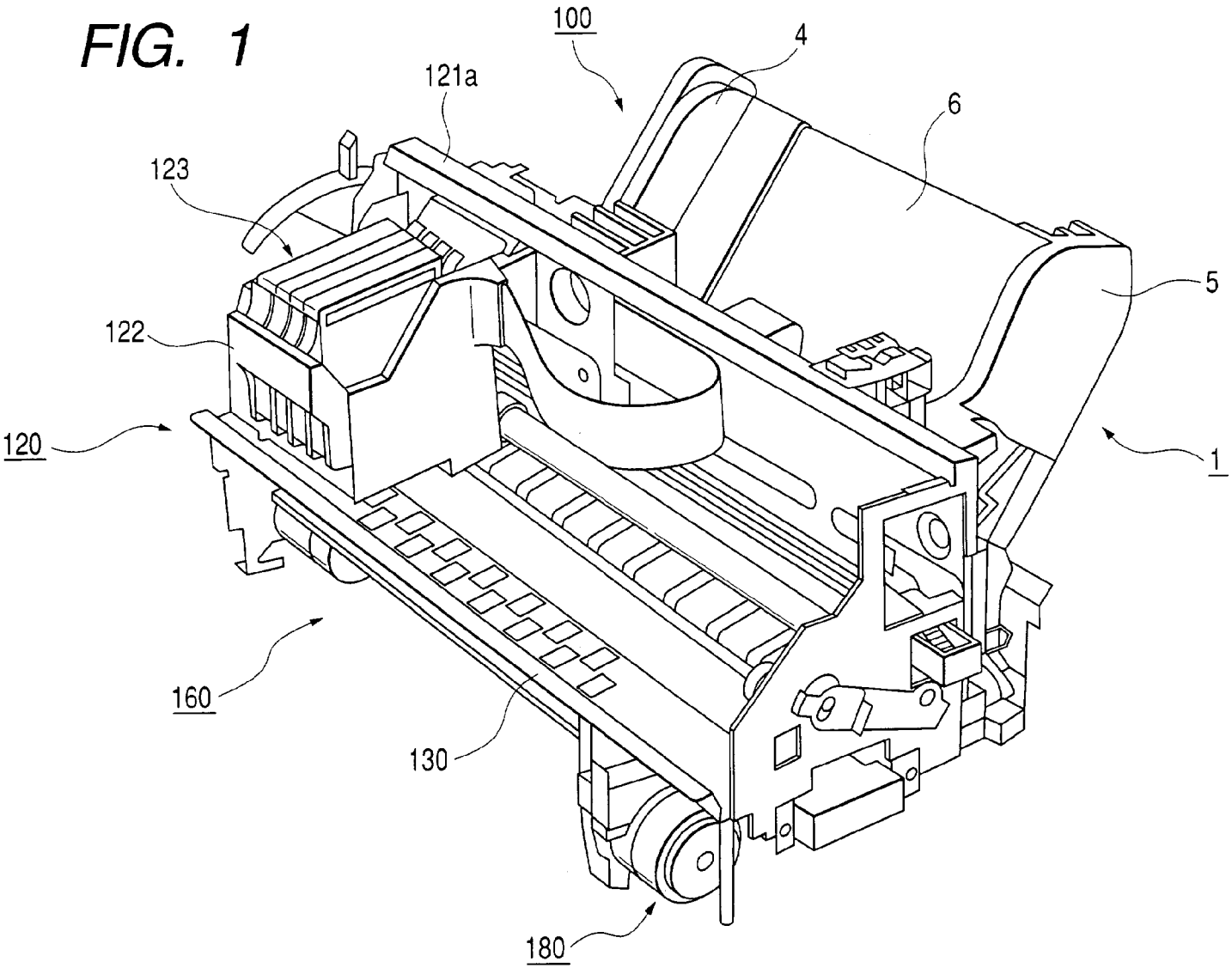
FIG. 1 is an external perspective view of a printer main unit of an ink jet printer according to the invention.
Figure 3:
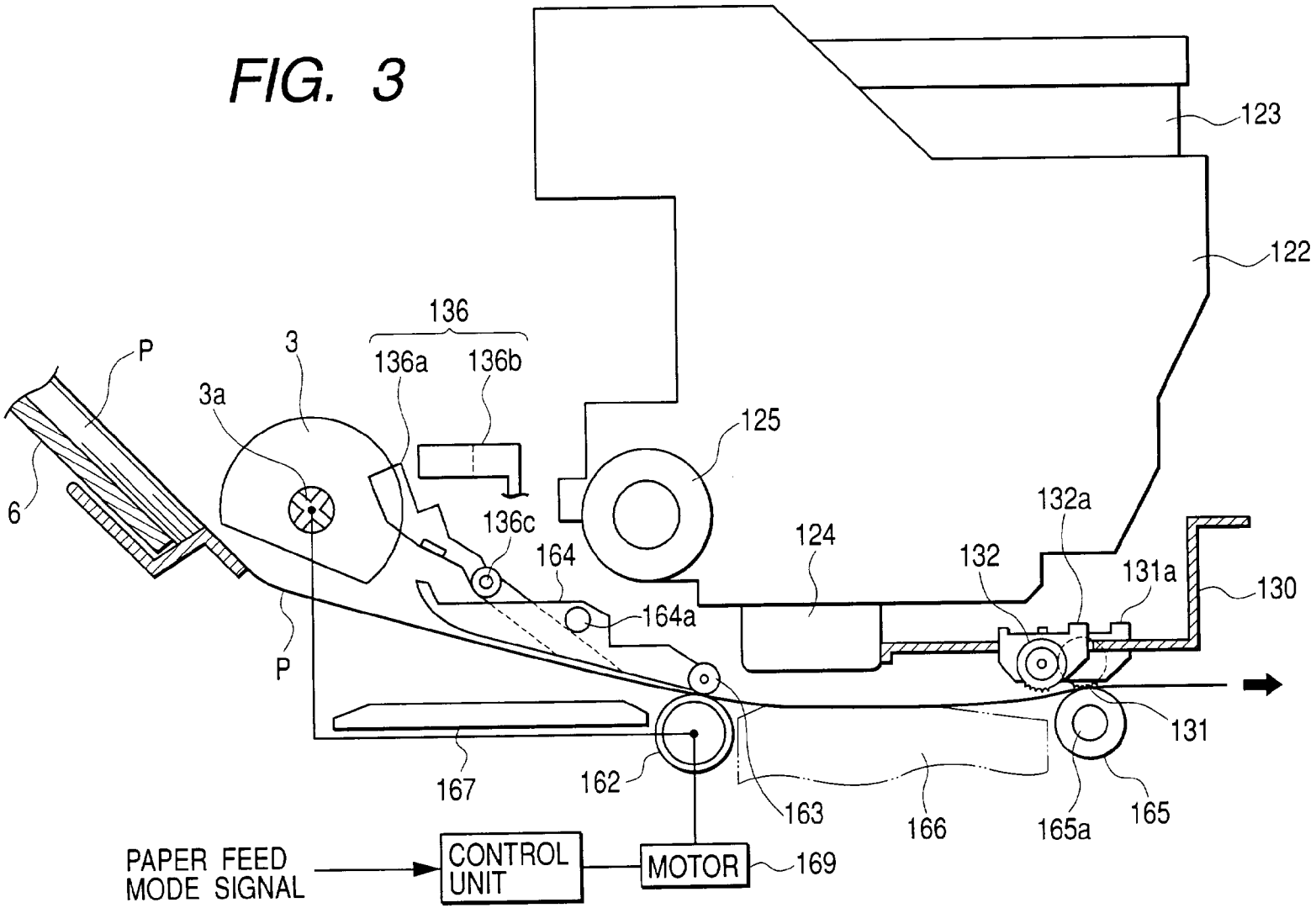
FIG. 3 is a sectional side view of the ink jet printer according to the invention.
Figure 4:
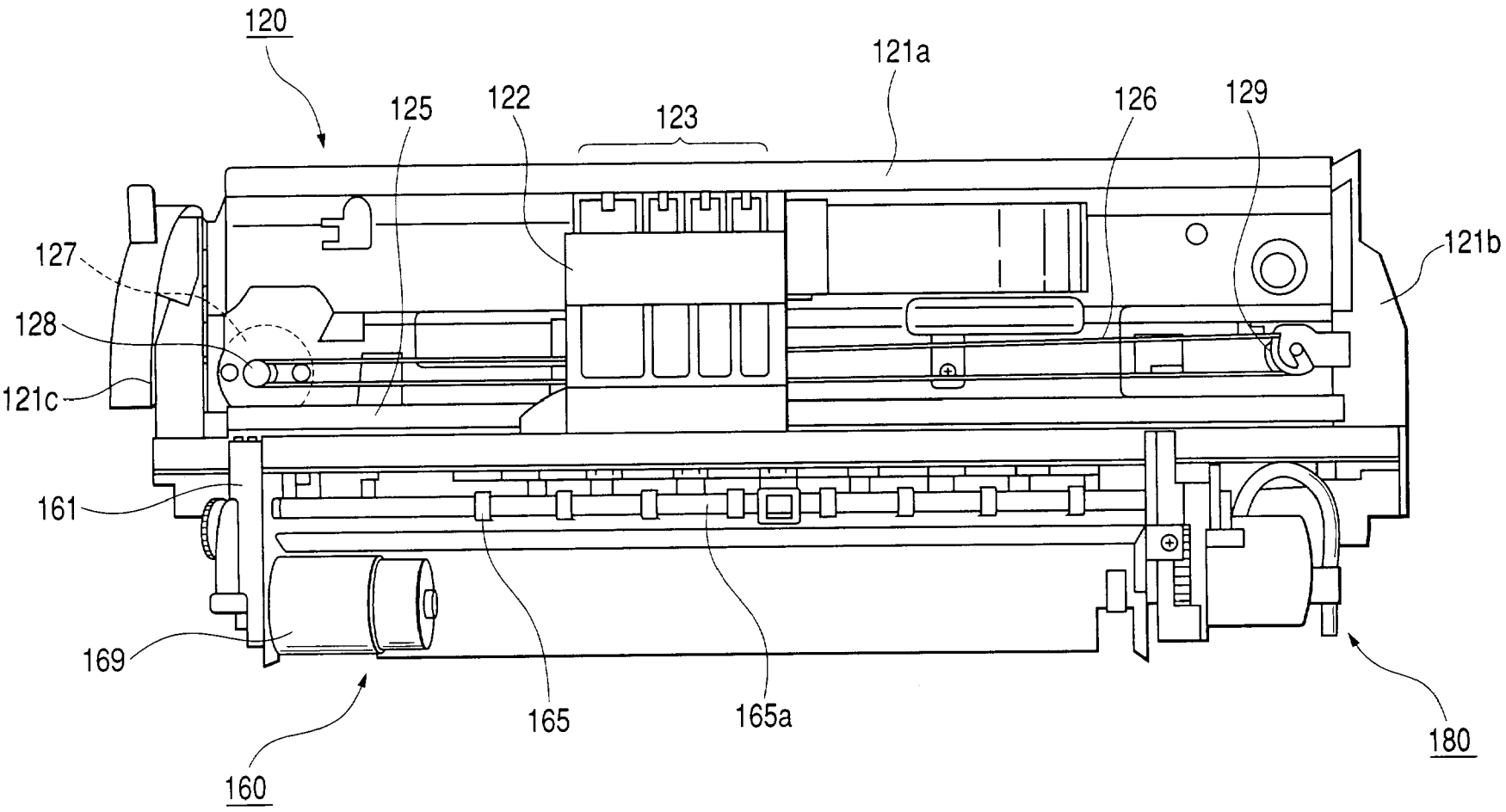
FIG. 4 is a front view of the printer main unit of the ink jet printer according to the invention.

The general configuration of an ink jet printer according to one embodiment of the invention will be discussed with reference to FIGS. 1 to 4. FIG. 1 is an external perspective view of a printer main unit of the ink jet printer (simply, printer) 100, FIG. 2 is an exploded perspective view of the printer main unit of the printer, FIG. 3 is a sectional side view of the printer main unit of the printer, and FIG. 4 is a front view of the printer main unit of the printer.

Figure 2:
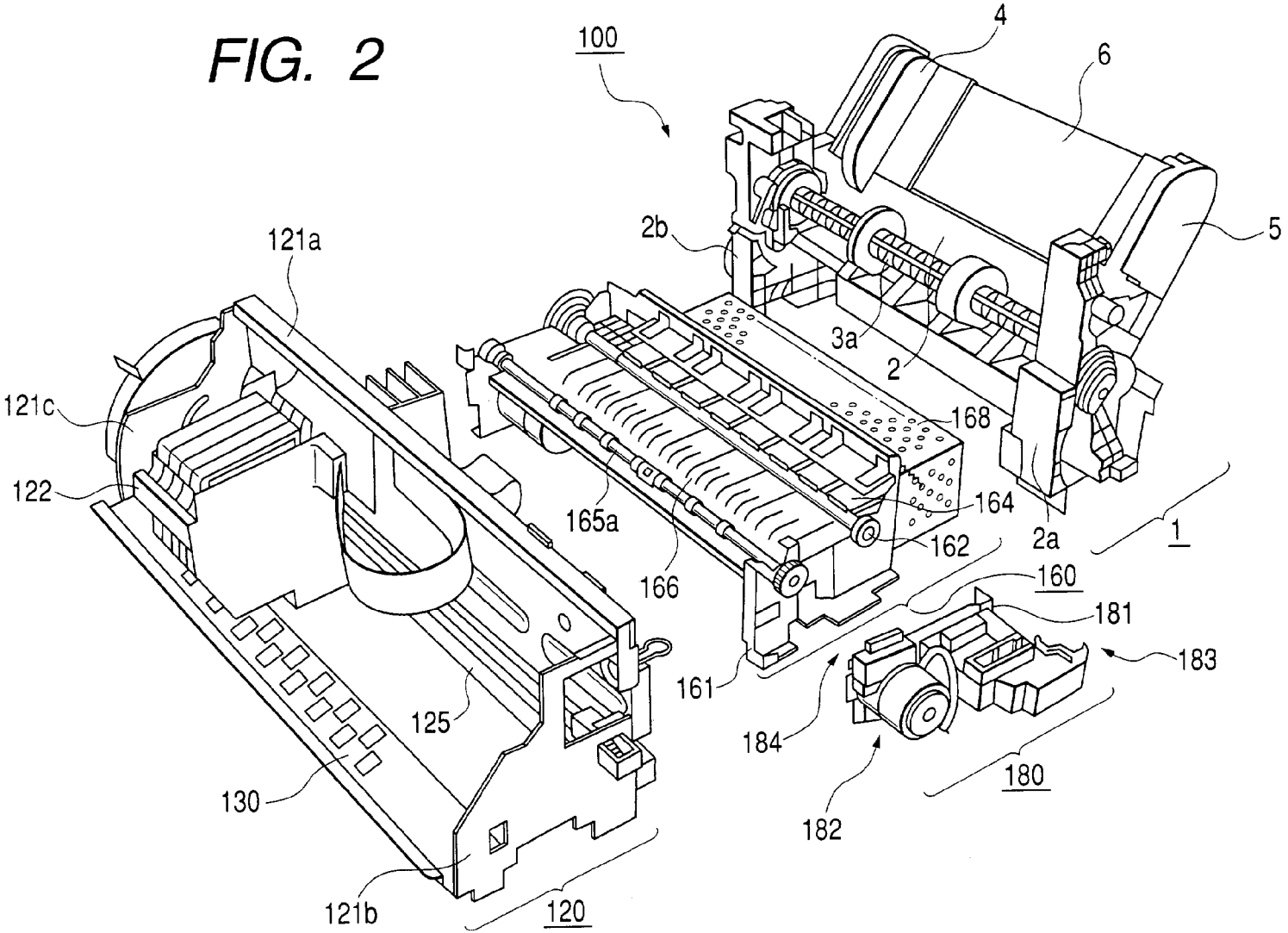
FIG. 2 is an exploded perspective view of the printer main unit of the ink jet printer according to the invention.

In FIGS. 1 and 2, the printer main unit of the printer 100 is divided into a plurality of units and the units are combined into the printer main unit. In the figures, numeral 1 denotes a paper feed unit as a paper feeder capable of feeding paper P (see FIG. 3) or roll paper (not shown) as record material, numeral 120 denotes a carriage unit comprising a carriage 122 having an ink jet record head 124 (see FIG. 3), numeral 160 denotes a transport unit for transporting the paper P, and numeral 180 denotes an ink system unit for maintaining the ink jet record head 124. The printer main unit of the printer 100 is divided into the four units as shown in FIG. 2 and the four units are combined into the printer main unit as shown in FIG. 1. In the embodiment, the carriage unit 120 and the ink system unit 180 are joined to the top and the right (in FIG. 4) of the transport unit 160 respectively and the paper feed unit 1 is joined to the rear of the carriage unit 120, whereby the four units are combined into the printer main unit.

Next, the paper transport passage of the printer 100 will be discussed with reference to FIG. 3. Hereinafter, the left of FIG. 3 (the rear of the printer 100) will be referred to as "upstream" and the right of FIG. 3 (the front of the printer 100) will be referred to as "downstream." The printer 100 comprises a hopper 6 placed upstream for stacking sheets of paper P as single sheets of paper on the hopper 6 in an inclined attitude. The hopper 6 is placed rotatably clockwise and counterclockwise in FIG. 3 with a rotation shaft 6*a* (see FIG. 7) positioned in an upper part as the center. As the hopper 6 rotates, a lower part of the hopper 6 is pressed against and is brought away from a paper feed roller 3. The hopper 6 also comprises a moving guide 4 slidable in the width direction of the paper P (see FIG. 1) for guiding the side end of each of stacked sheets of the paper P together with a fixed guide 5 (see FIG. 1). The top one of the stacked sheets of the paper P is paid out downstream as the hopper 6 is pressed against the paper feed roller 3 and the paper feed roller 3 is rotated in the press state. The paper feed roller 3 is shaped roughly like a letter D as a side view. At the print operation time, the paper feed roller 3 is controlled so that a flat portion of the paper feed roller 3 is opposed to the paper P (state in FIG. 3), thereby preventing transport load of the paper P from occurring.

The length of a circular arc portion of the paper feed roller 3 is set to a length to allow the paper P to be paid out from the top of the hopper 6 and the tip of the paid-out paper P to arrive at a nip point between a transport drive roller 162 and a transport driven roller 163, namely, is set equal to or more than the paper feed passage length from the press contact between the paper feed roller 3 and the paper P to the nip point between the transport drive roller 162 and the transport driven roller 163. Therefore, for example, to enable a larger number of sheets of paper P to be stacked on the hopper 6 in FIG. 3, the placement position of the paper feed roller 3 needs to be moved upward (to the upper left) in FIG. 3. In such a case, the diameter of the paper feed roller 3 is made large (in the embodiment, 48 mm), whereby it is made possible to cope with change in the paper feed passage length accompanying the upward move of the placement position of the paper feed roller 3.

Next, a paper guide 167 as a plate-like body is placed roughly horizontally on the downstream bottom from the paper feed roller 3. The tip of the paper P to be paid out by the paper feed roller 3 abuts the paper guide 167 slantingly and is moved smoothly downstream. Placed downstream from the paper guide 167 are the transport drive roller 162 which is rotated and the transport driven roller 163 pressed against the transport drive roller 162. The paper P is nipped between the transport drive roller 162 and the transport driven roller 163 and is transported downstream at a constant pitch.

The transport driven roller 163 is journaled by a transport driven roller holder 164 downstream thereof. The transport driven roller holder 164 is placed rotatably clockwise and counterclockwise in FIG. 3 with a rotation shaft 164*a* as the center and is urged for rotation by a torsion coil spring (not shown) in a direction in which the transport driven roller 163 is always pressed against the transport drive roller 162 (clockwise in FIG. 3).

Next, a paper detector 136 consisting of a sensor main unit 136*b* and a detector 136*a* for detecting passage of the paper P is disposed in the proximity of the transport driven roller holder 164 positioned most to the 0 digit side (the right front of FIG. 2). The detector 136*a* is shaped roughly like V as a side view and is placed rotatably clockwise and counterclockwise in FIG. 2 with a rotation shaft 136*c* in the center vicinity of the detector 136*a* as the center. The sensor main unit 136*b* positioned above the detector 136*a* comprises a light emission section (not shown) and a light reception section (not shown) for receiving light from the light emission section. The upper side of the detector 136*a* from the rotation shaft 136*c* shuts off the light emitted from the light emission section to the light reception section and allows the light to pass through as it is rotated. Therefore, if the detector 136*a* is rotated so as to be pushed upward with the passage of the paper P as shown in FIG. 3, the upper side of the detector 136*a* is detached from the sensor main unit 136*b* and accordingly the light reception section receives light, so that the passage of the paper P is detected.

Next, a platen 166 and the ink jet record head 124 are disposed downstream from the transport drive roller 162 so that they are vertically opposed to each other. The platen 166 is long in a main scanning direction (see FIG. 2). The paper P transported to below the ink jet record head 124 as the transport drive roller 162 rotates is supported by the platen 166 from below the paper P. The ink jet record head 124 is placed on the bottom of the carriage 122 on which an ink cartridge 123 is mounted. The carriage 122 reciprocates in the main scanning direction while it is guided by a carriage guide shaft 125 extending in the main scanning direction. In the embodiment, the ink cartridge 123 comprises four separate color ink cartridges (black, yellow, cyan, and magenta ink cartridges) as shown in FIG. 4, and the four ink cartridges can be replaced separately.

Next, a paper ejection section of the printer 100 is formed downstream from the ink jet record head 124, and paper ejection drive rollers 165, a paper ejection driven roller 131, and a paper ejection auxiliary roller 132 are disposed. A plurality of paper ejection drive rollers 165 are attached to a rotated paper ejection drive roller shaft 165*a* over the axial direction thereof (see FIG. 4). The paper ejection driven roller 131 journaled by a paper ejection driven roller holder 131*a* attached to a paper ejection frame 130 is pressed lightly against the paper ejection drive roller 165, whereby it is driven and rotated. Therefore, the paper P printed by the ink jet record head 124 is ejected in a paper ejection direction (arrow direction in FIG. 3) as the paper ejection drive rollers 165 are rotated in a state in which the paper P is nipped between the paper ejection drive rollers 165 and the paper ejection driven roller 131. The paper ejection auxiliary roller 132 journaled by a paper ejection auxiliary roller holder 132*a* is placed a little upstream from the paper ejection driven roller 131 for preventing the paper P from floating up from the platen 166 so as to a little press downward the paper P, thereby regulating the distance between the paper P and the ink jet record head 124.

The hopper 6, the moving guide 4, the fixed guide 5, and the paper feed roller 3 described above are placed in the above-described paper feed unit 1 shown in FIGS. 1 and 2. The paper feed unit 1 has a base made of a paper feed unit frame 2 comprising a right attachment part 2*a* and a left attachment part 2*b* each shaped roughly like a pillar, placed upright at the left and the right with the hopper 6 between, as shown in FIG. 2. The hopper 6, a paper feed roller shaft 3*a* of a rotation shaft of the paper feed roller 3, and the like are placed on the paper feed unit frame 2. The paper feed unit 1 is joined to the rear of the carriage unit 120 in the upper parts of the attachment part 2*a* and the attachment part 2*b*. The more detailed configuration of the paper feed unit 1 will be discussed later.

Next, the paper guide 167, the transport drive roller 162, the transport driven roller holder 164, and the paper ejection drive roller shaft 165*a* are placed in the transport unit 160 shown in FIGS. 1 and 2. The transport unit 160 has a base made of a transport unit frame 161 shaped roughly like angular U as a plan view, as shown in FIG. 2. The transport unit 160 comprises a power unit 168 of a power supply section of the printer 100 on the rear, journals the paper ejection drive roller shaft 165*a* on the front and the transport drive roller 162 almost at the center, and comprises the platen 166 in an upper front part and the transport driven roller holder 164 in an upper center. The transport unit 160 also comprises a drive motor 169 (see FIG. 4) of a common drive source to the paper feed roller 3, the transport drive roller 162, the paper ejection drive rollers 165, a pump unit 182 (described later), and a blade unit 184 (described later) in a lower left part. The drive motor 169 and the five types of components to be driven by the drive motor 169 are joined by a power transmission mechanism (not shown) and the components can be selectively driven in the state in which the four units are combined as shown in FIG. 1.

The ink system unit 180 as a maintenance device of the ink jet record head 124, joined to the right side of the transport unit 160 comprises a frame 181 as the base of the ink system unit 180, joined to the right side of the transport unit frame 161, and comprises a cap unit 183, the pump unit 182, and the blade unit 184 on the frame 181, as shown in FIG. 2. When the carriage 122 moves to a home position (right area of FIG. 4), the cap unit 183 caps the ink jet record head 124 to protect a nozzle face (not shown) and the pump unit 182 supplies a negative pressure to the cap unit 183 in the cap state for sucking ink through nozzle openings of the ink jet record head 124. The blade unit 184 can be moved between a position crossing the reciprocating area of the carriage 122 and a position retreating from the reciprocating area. The blade unit 184 is moved to the position crossing the reciprocating area of the carriage 122 and the carriage 122 is moved from a print area to the home position (right area of FIG. 4) or from the home position to the print area, whereby the nozzle face (not shown) of the ink jet record head 124 is wiped for cleaning.

The carriage guide shaft 125 and the paper detector 136 are placed in the carriage unit 120. The carriage unit 120 has a base made up of a main frame 121*a* and a right side frame 121*b* and a left side frame 121*c* placed upright on both sides of the main frame 121*a*, and journals the carriage guide shaft 125 on the rear, as shown in FIG. 2.

As shown in FIG. 4, the carriage unit 120 comprises a carriage motor 127 on the left rear, and a drive pulley 128 is attached to the carriage motor 127. The carriage unit 120 comprises a driven pulley 129 at the right. A carriage belt 126 is placed on the drive pulley 128 and the driven pulley 129 and a part of the carriage belt 126 is fixed to the carriage 122. Therefore, the carriage 122 is reciprocated in the main scanning direction (from side to side in FIG. 4) as the carriage motor 127 is turned.

In FIG. 2, the paper ejection frame 130 is attached to the carriage unit 120, but can be attached not only to the carriage unit 120, but also to the transport unit 160.

The description of the configuration of the printer main unit of the printer 100 is now complete. The four units are combined and joined, whereby the printer 100 can be operated.

<Detailed Configuration of Paper Feed Unit>

Figure 5:
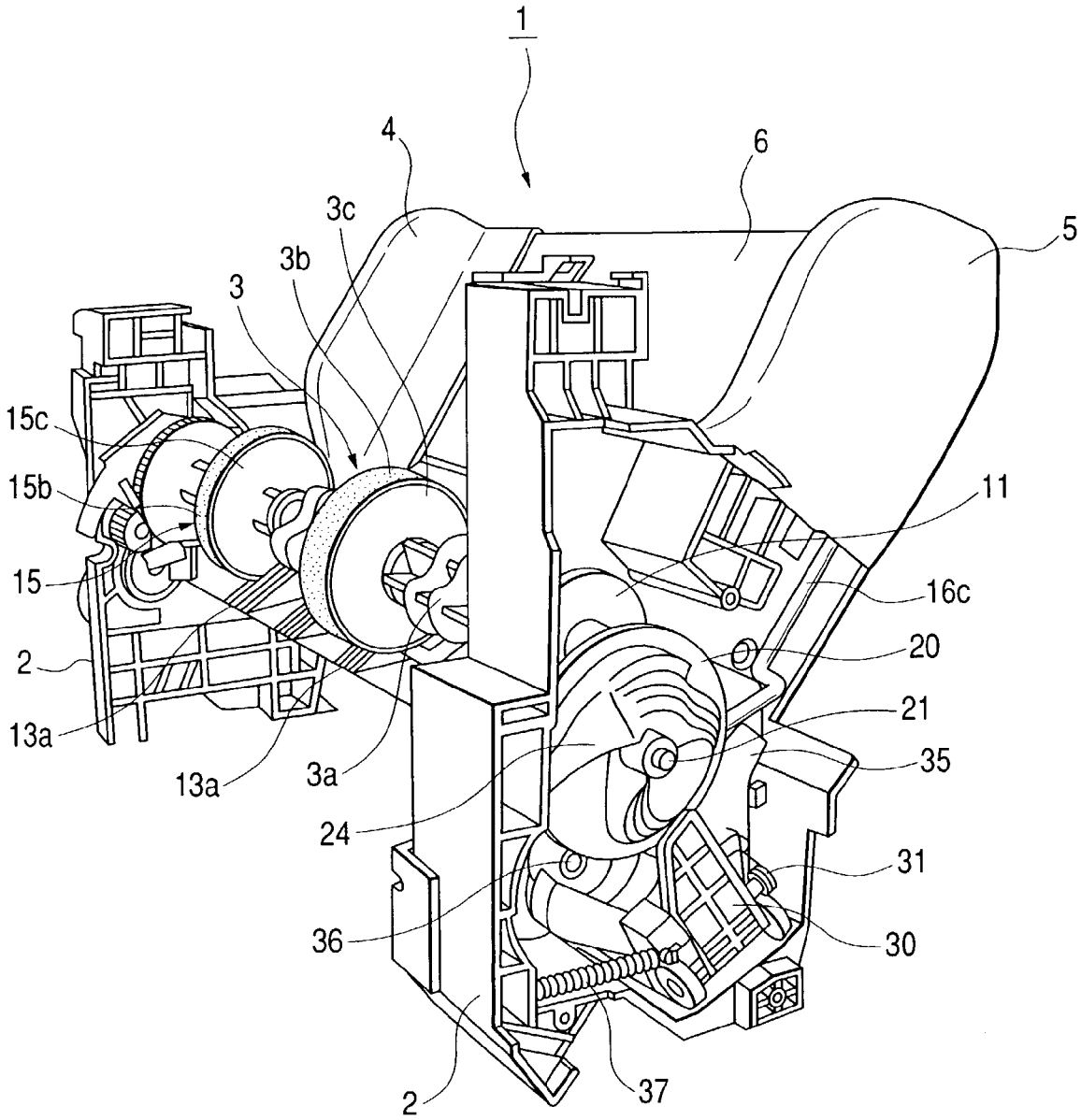
FIG. 5 is a perspective view of a paper feeder according to the invention.
Figure 7:
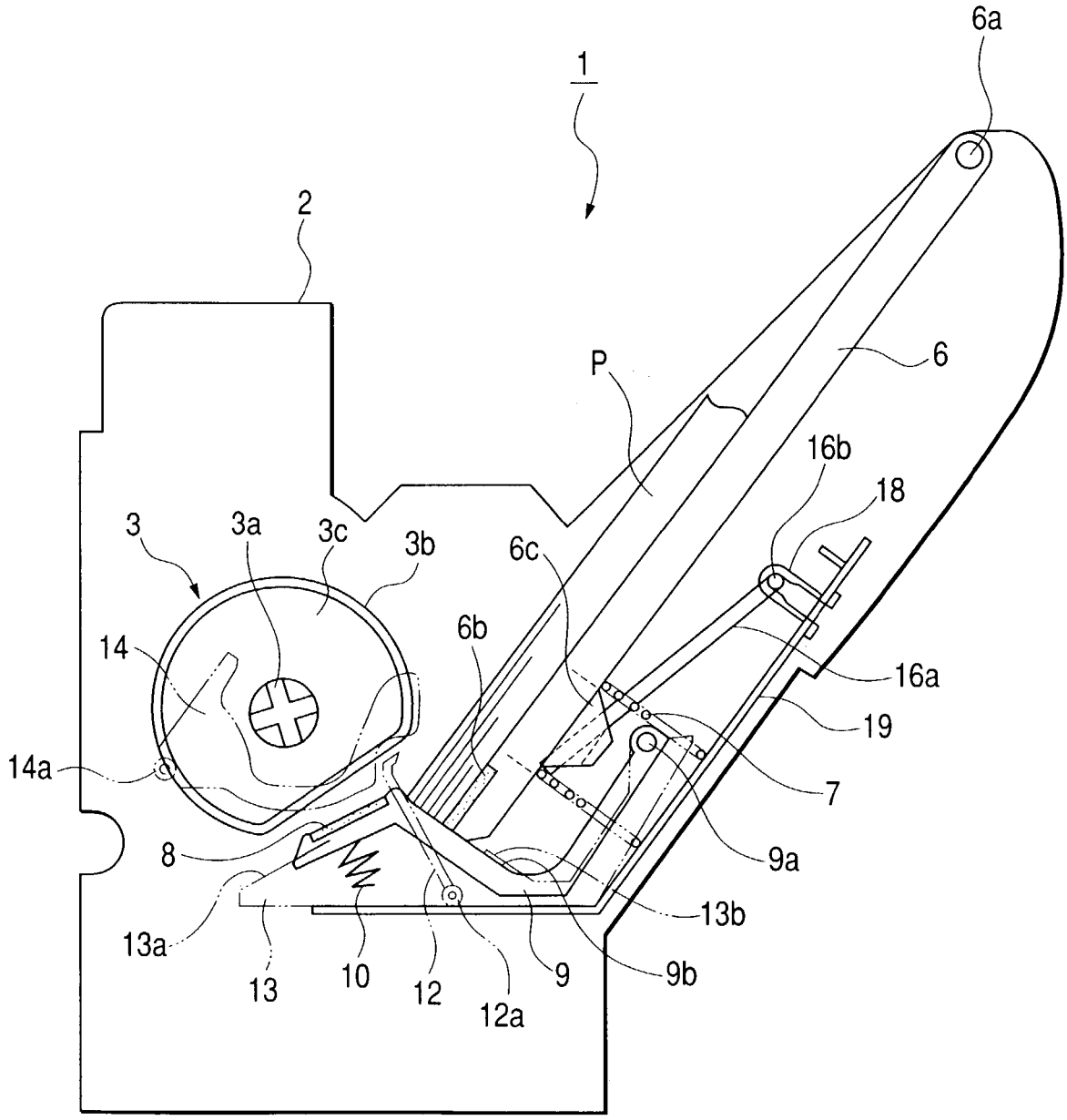
FIG. 7 is a sectional side view of the paper feeder according to the invention.
Figure 8A:
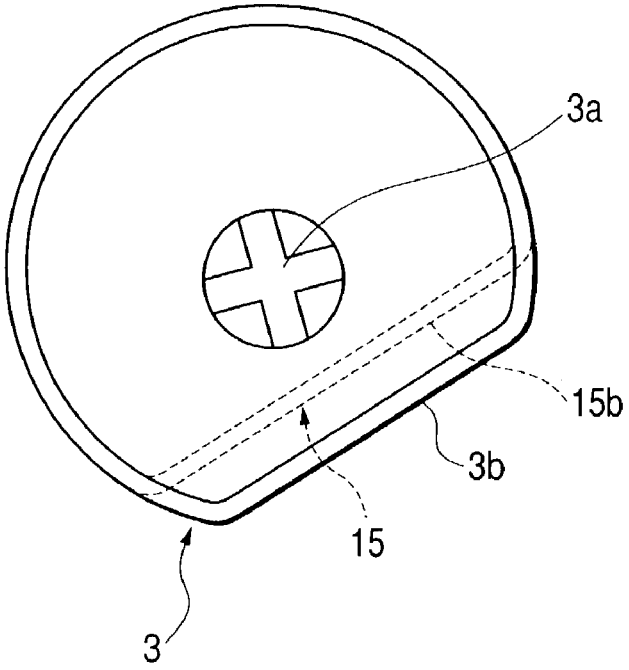
FIGS. 8A and 8B are a side view and a front view of a paper feed roller and a paper feed auxiliary roller.
Figure 8B:
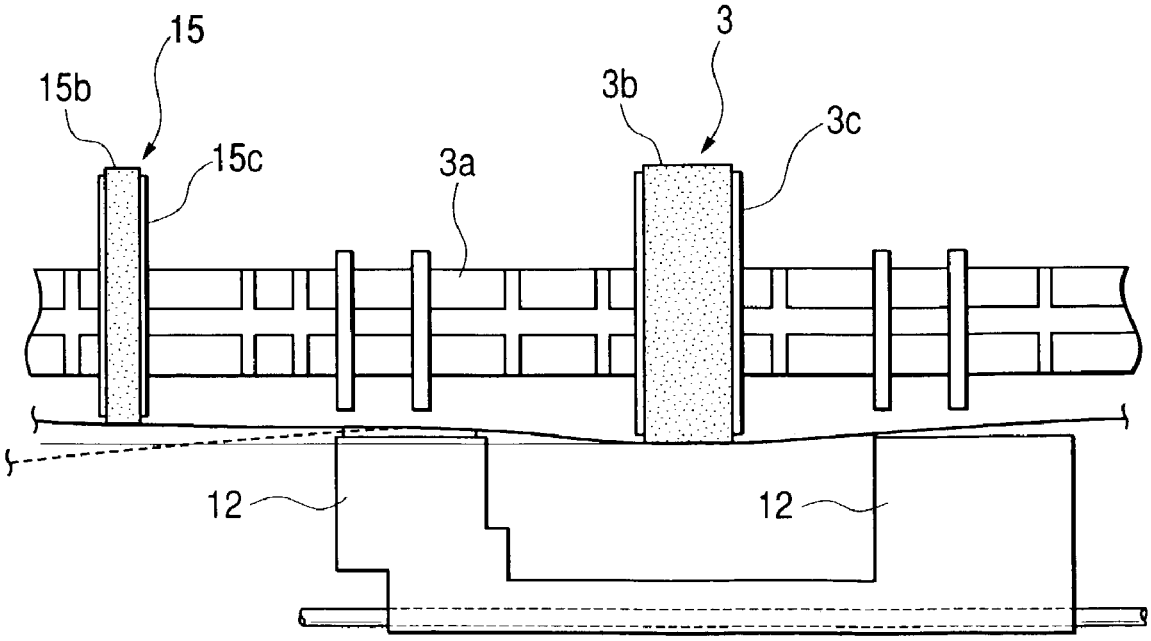
Figure 9A:
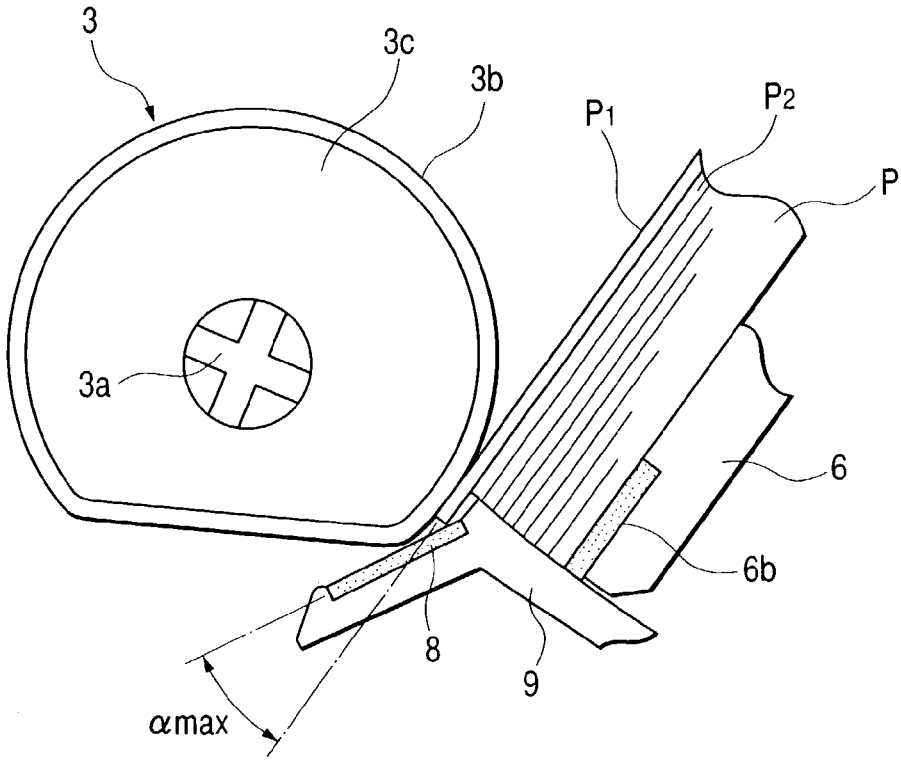
FIGS. 9A and 9B are schematic representations of a rush angle of paper P into a separation pad 8 (partially enlarged view of FIG. 7)
Figure 9B:
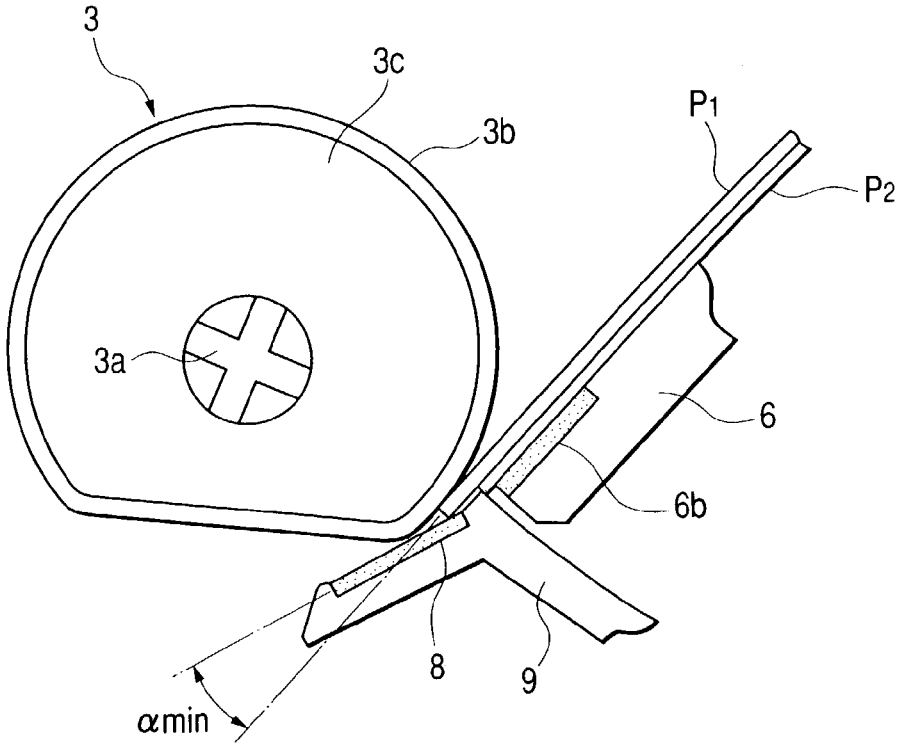

Next, the detailed configuration (general configuration) of the paper feed unit 1 will be discussed with reference to FIGS. 5 to 9B. FIG. 5 is an external perspective view of the paper feed unit 1, FIG. 6 is a front view of the paper feed unit 1, FIG. 7 is a sectional side view is of the paper feed unit 1, FIGS. 8A and 8B are a side view and a front view of the paper feed roller 3 and a paper feed auxiliary roller 15, and FIGS. 9A and 9B are a schematic representation of a rush angle of paper P into a separation pad 8 (partially enlarged view of FIG. 7).

To begin with, the paper feed unit 1 has the base made of the paper feed unit frame 2 as described above and comprises a transmission gear unit 17 on the left side of the paper feed unit frame 2 (the left of FIG. 6), a hopper release device consisting of a rotary cam 20, etc., (described later) on the right side of the paper feed unit frame 2 (the right of FIG. 6), and a paper feed roller shaft 3*a* placed therebetween.

The transmission gear unit 17 meshes with a transmission gear (not shown) of the transport unit 160 in a state in which the paper feed unit 1 is joined to the carriage unit 120 (see FIG. 1), and transmits rotation force of the drive motor 169 (see FIG. 4) attached to the transport unit 160 to the paper feed roller shaft 3*a*. Therefore, the paper feed unit 1 (paper feed roller shaft 3*a*) uses the drive motor 169 of the drive source of the transport drive roller 162, etc., as the power source and thus does not have its own drive source, so that the paper feed unit 1 is formed at low cost. The paper feed roller shaft 3*a* transmits the rotation force given to the left end by the transmission gear unit 17 to the hopper release device (described later) placed at the right end. Therefore, the paper feed roller shaft 3*a* in the embodiment serves not only a function as the rotation shaft of the paper feed roller 3, but also a function as the power transmission shaft.

Figure 6:
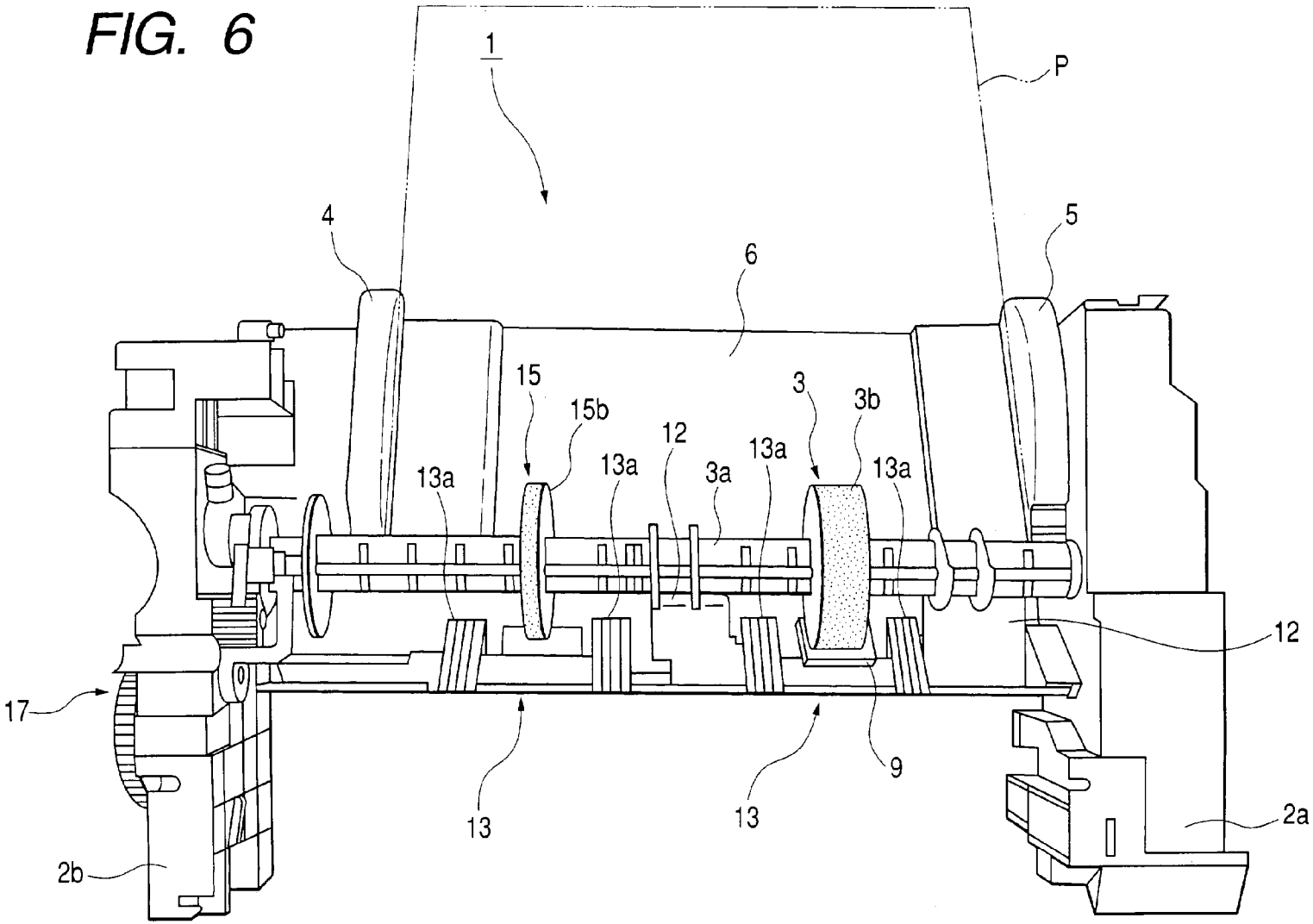
FIG. 6 is a front view of the paper feeder according to the invention.

The paper feed roller 3 rotated by the paper feed roller shaft 3*a* is placed at the right end, namely, at a position at a distance from the transmission gear unit 17 as shown in FIG. 6. The paper feed roller 3 is shaped roughly like a letter D as a side view as mentioned above and is made up of a roller main body 3*c* resin-molded integrally with the paper feed roller shaft 3*a* and a rubber member 3*b* as an "elastic member" wound around the outer peripheral portion of the roller main body 3*c*, as shown in FIGS. 5 and 7. The rubber member 3*b* provides a friction coefficient with the paper P, so that the paper P pressed against the paper feed roller 3 is reliably fed without slip. In the embodiment, EPDM (ethylene propylene rubber) is used as the rubber member 3*b*. A paper feed auxiliary roller 15 shaped roughly like a letter D as a side view in the axial direction is placed on the paper feed roller shaft 3*a* between the left end of the paper feed roller shaft 3*a* and the paper feed roller 3; it will be discussed later in detail.

Next, the hopper 6 made of a plate-like body long in the width direction of the paper P is placed in the paper feed unit 1 in an inclined attitude as shown in FIG. 7. The hopper 6 is placed rotatably clockwise and counterclockwise in FIG. 7 with the rotation shaft 6*a* as is the center, as described above, and a helical compression spring 7 as "urging device" for urging the lower part of the hopper toward the paper feed roller 3 is placed in a lower part of the rear of the hopper 6, so that the hopper 6 is always urged and rotated in a direction in which it is pressed against the paper feed roller 3. The paper feed unit 1 comprises "hopper release device" for rotating the hopper 6 in a direction in which the hopper 6 is brought away from the paper feed roller 3. The configuration and function of the hopper release device will be discussed later in detail.

Next, a separation pad holder 9 and a guide member 13 are placed below the hopper 6. The separation pad holder 9 is placed at a position opposed to the paper feed roller 3 as shown in FIG. 6 and holds a separation pad 8 made of a frictional member so that the separation pad 8 is opposed to the paper feed roller 3 as shown in FIG. 7. The separation pad holder 9 is placed rotatably clockwise and counterclockwise in FIG. 7 with a rotation shaft 9*a* as the center, and is urged and rotated by a helical compression spring 10 in a direction in which the separation pad 8 is pressed against the paper feed roller 3. Therefore, if the paper feed roller 3 is rotated from the state shown in FIG. 7 (in which the separation pad 8 and the flat portion of the paper feed roller 3 face each other), the separation pad 8 is pressed against the circular arc portion of the paper feed roller 3.

The top sheet of paper P abutted against (rushed into) the separation pad 8 placed in the separation pad holder 9 at abutment angle $\alpha$ is sandwiched between the separation pad 8 and the paper feed roller 3, thereby preventing duplicate delivery of the next sheet of paper R More particularly, letting the friction coefficient between the paper feed roller 3 and paper P be $\mu 1$, the friction coefficient between sheets of paper P be $\mu 2$, and the friction coefficient between paper P and the separation pad 8 be $\mu 3$, the materials of the rubber member 3*b* and the separation pad 8 are selected so that the relation $\mu 1>\mu 3>\mu 2$ holds. Therefore, the top sheet of paper P to be fed is paid out reliably downstream with rotation of the paper feed roller 3 and the next sheet of paper P remains on the separation pad 8, so that duplicate delivery of paper P is prevented. In a lower part of the hopper 6, a retention pad 6*b* is placed at a position opposed to the paper feed roller 3 and the paper feed auxiliary roller 15 (described later) for retaining a bundle of sheets of paper P retained on the hopper 6 so that the entire bundle is not moved downstream when the top sheet of paper P is fed.

By the way, the fluctuation range of the abutment angle $\alpha$ in the embodiment, namely, the placement position of the rotation shaft 6*a* determining the swing angle of the hopper 6 and the feed direction dimension of the hopper 6 (length direction dimension of paper P) are set as follows: The angle at which the hopper swings from the state in which the hopper 6 is most away from the paper feed roller 3 to the state in which the top sheet of paper P is pressed against the paper feed roller 3 changes depending on the number of sheets of paper P stacked on the hopper 6 and accordingly the abutment angle $\alpha$ at which the paper P tip abuts the separation pad 8 also changes. FIGS. 9A and 9B show the angle; FIG. 9A shows abutment angle $\alpha_{max}$ when the number of set sheets of paper P is the maximum and FIG. 9B shows abutment angle $\alpha_{min}$ when the number of set sheets of paper P is almost the minimum. As seen in the figures, the larger the number of set sheets of paper P, the larger the abutment angle $\alpha$. In FIGS. 9A and 9B, numeral $P_1$ indicates the top sheet of paper and numeral $P_2$ indicates the next sheet of paper to the sheet $P_1$ of paper.

However, in FIG. 9A, when the abutment angle $\alpha_{max}$ becomes larger than the maximum value $\alpha_1$ of the abutment angle at which the top sheet of paper P can pass through, the top sheet $P_1$ of paper to be fed is caught in the separation pad 8 and may not be fed. In contrast, when the abutment angle $\alpha_{min}$ becomes smaller than the minimum value $\alpha_2$ of the abutment angle at which duplicate delivery of sheets of paper P can be prevented, the next sheet $P_2$ of paper (or a plurality of sheets of paper P on and after the sheet $P_2$ of paper) is inserted between the sheet $P_1$ of paper to be fed and the separation pad 8 and duplicate delivery of the sheets of paper may occur. Then, in the embodiment, the placement position of the rotation shaft 6*a* of the hopper 6 and the feed direction dimension of the hopper 6 are set so that the abutment angle $\alpha$ maintains the relation $\alpha_2 \leqq \alpha \leqq \alpha_1$ regardless of the number of sheets of paper P stacked on the hopper 6. Therefore, the abutment angle $\alpha_{max}$ does not exceed the upper limit value $\alpha_1$ and the abutment angle $\alpha_{min}$ does not fall below the lower limit value $\alpha_2$ regardless of the number of stacked sheets of paper P, so that the appropriate paper feed operation can always be performed. In the embodiment, the feed direction length of the hopper 6 is about 130 mm and the swing angle of the hopper 6 is about 10 deg. In this case, however, the swing angle 2 deg of the hopper 6 until the top sheet of paper P is pressed against the paper feed roller 3 when a maximum number of sheets of paper are set is not contained.

Next, the guide member 13 will be discussed. As shown in FIG. 6, one guide member 13 comprises two smooth guide faces 13*a* for guiding paper P downstream (see FIG. 7) at a predetermined interval in the width direction of paper P, and two guide members 13 each having the two guide faces 13*a* are placed at a predetermined interval in the width direction of paper P. The guide member 13 comprises an abutment face 13*b* connected to the guide face 13*a*, which the tip of paper P stacked in an inclined attitude abuts roughly vertically (see FIG. 7). The abutment face 13*b* is formed by a circular arc (curved face) with the rotation shaft 6*a* of the hopper 6 as the center, and the tip of paper P stacked on the hopper 6 in the inclined attitude slides over the abutment face 13*b* as the hopper 6 is rotated.

If the friction coefficient between the abutment face 13*b* and the tip of paper P is large, it takes time in the press operation of pressing the top sheet of paper P against the paper feed roller 3 by rotating the hopper 6 and the paper feed operation may be adversely affected. Thus, it is desirable that the friction coefficient should be low as much as possible (for example, $\mu<0.3$). Therefore, in the embodiment, the guide members are molded of resin using POM (polyoxymethylene) or AES (acrylonitrile-ethylene styrene) and further a lubricant is applied to the abutment faces 13*b*, whereby a low friction coefficient is provided. The separation pad holder 9 is also formed with an abutment face 9*b* similar to the abutment face 13*b*.

Next, as shown in FIGS. 5 and 6, the paper feed auxiliary roller 15 is placed on the paper feed roller shaft 3*a* between the paper feed roller 3 and the transmission gear unit 17. The paper feed auxiliary roller 15 is shaped roughly like a letter D as a side view in the axial direction of the paper feed roller shaft 3*a* as described above. Like the paper feed roller 3, the paper feed auxiliary roller 15 is made up of a roller main body 15*c* resin-molded integrally with the paper feed roller shaft 3*a* and a rubber member 15*b* as an "elastic member" wound around the outer peripheral portion of the roller main body 15*c* for preventing damage to the print side of paper P.

The described paper feed auxiliary roller 15 serves the following two functions in the paper feed unit 1 according to the embodiment:

First, the paper feed auxiliary roller 15 serves the function of regulating the feed attitude of paper P. That is, the paper feed roller 3 and the separation pad 8 are provided in a pair and thus it is desirable that only one pair of the paper feed roller 3 and the separation pad 8 should be provided as in the embodiment to meet the demand for cost reduction; to handle various sizes of paper P, particularly to handle paper P having a small width direction dimension, the pair of the paper feed roller 3 and the separation pad 8 is placed at a position to the 0 digit side (the right of FIG. 6).

However, the paper feed unit 1 feeds paper P with the paper P bent so as to become downward convex by the paper feed roller 3 as shown in FIG. 3. Thus, if the paper feed roller 3 is placed at a position to the 0 digit side, the paper P is not uniformly bent over the width direction, namely, the side of the paper P where the paper feed roller 3 is not disposed (the left of FIG. 6) is not bent as compared with the side of the paper P where the paper feed roller 3 is disposed and accordingly it is feared that a difference may occur between the left and right advance degrees at the paper P tip, causing a skew to occur. Therefore, the paper feed auxiliary roller 15 is placed on the side where the paper feed roller 3 is not disposed, thereby regulating the bend attitude of the paper P so that it becomes uniform for accomplishing the normal paper feed operation.

The paper feed auxiliary roller 15 is shaped roughly like a letter D as a side view like the paper feed roller 3 and is formed in the same diameter as the paper feed roller 3, but the flat portion in the letter D shape is further cut as compared with that of the paper feed roller 3, as shown in FIG. 8A. As shown in the figure, the flat portion of the paper feed auxiliary roller 15 is cut to the rotation center side (the side of the paper feed roller shaft 3*a*) as compared with the flat portion of the paper feed roller 3 (for example, 4 mm relative to the diameter 48 mm of the paper feed roller 3, the paper feed auxiliary roller 15).

The reason is as follows: When paper P is transported (at the print operation time), the flat portion of the paper feed roller 3 (the paper feed auxiliary roller 15) is opposed to the paper P as shown in FIG. 7 to lessen the transport load (rotation load of the transport drive roller 162 (see FIG. 3)). Paper return levers 12 and 12 are disposed below the paper feed roller 3 as shown in FIG. 8A (also see FIG. 7) and the paper P is a little warped by the paper feed roller 3 and the paper return levers 12 and 12 in a width direction view as shown in FIG. 8B. At this time, if the paper feed auxiliary roller 15 is of the same shape as the paper feed roller 3, the paper P is warped further like a convex shape as indicted by the dashed line in FIG. 8B, and the disadvantage of increasing the transport load by the rigidity of the paper P and friction of the paper feed roller 3, the paper feed auxiliary roller 15, and the paper return levers 12 occurs. Therefore, the shape of the paper feed auxiliary roller 15 is made different from that of the paper feed roller 3 as described above, whereby unnecessary warpage is not given to the paper P and an increase in the transport load is prevented.

By the way, as the paper P indicated by the phantom line in FIG. 6, A4-size paper is set in portrait orientation, and in the embodiment, the paper feed roller 3 and the paper feed auxiliary roller 15 are placed equally matching the width dimension of the A4-size paper P as shown in the figure. Therefore, the feed attitude of A4-size paper P generally frequently used can be regulated most uniformly and the effect of the paper feed auxiliary roller 15 can be produced most efficiently. However, the disposition of the paper feed auxiliary roller 15 is not limited to that in the embodiment and may be any position if the position is a position for enabling the paper P to be fed normally, namely, the feed attitude of the paper P to be regulated.

Second, the paper feed auxiliary roller 15 serves the function as a "twist suppression member" for suppressing a twist of the paper feed roller shaft 3*a*. That is, the paper feed roller shaft 3*a* serves the function as the power transmission shaft for transmitting the rotation force (power) given by the transmission gear unit 17 placed at the left of the printer (the left of FIG. 6) to the hopper release device (described later) placed at the right of the printer (the right of FIG. 6) as described above. Therefore, when the power is transmitted to the hopper release device or when the paper feed operation of the paper feed roller 3 is performed, a load occurs on the paper feed roller shaft 3*a*, causing the paper feed roller shaft 3*a* to be twisted. If the paper feed roller shaft 3*a* is twisted, a phase shift occurs in the rotation operation of the paper feed roller 3 or the operation of the hopper release device to which the power is supplied, and it is made impossible to perform the normal paper feed operation and power transmission. Particularly, the paper feed roller 3 is placed at the position at a distance from the shaft end of the paper feed roller shaft 3*a* to which the rotation force is given (the left of FIG. 6) and thus the paper feed roller 3 still more easily receives the effect of the twist.

However, the paper feed auxiliary roller 15 is provided on the paper feed roller shaft 3*a*, so that the twist is decreased in the portion where the paper feed auxiliary roller 15 is placed and therefore it is made possible to lessen the above-described problem of the phase shift occurring accompanying the twist. Such a twist suppression section is additionally placed at any other position whenever necessary, whereby it is made possible to provide the advantage furthermore. At the time, the shape need not be the same as that of the paper feed roller 3 and may be any if it has a larger diametric dimension than that of the paper feed roller shaft 3*a*. In addition, in the embodiment, the paper feed roller shaft 3*a*, the paper feed roller 3 (roller main body 3*c*), and the paper feed auxiliary roller 15 (roller main body 15*c*) are molded in one piece using ABS resin, so that it is made possible to form the components at low cost and provide the above-described twist suppression effect furthermore. For example, if the paper feed auxiliary roller 15 and the paper feed roller shaft 3*a* are formed separately and the paper feed auxiliary roller 15 is attached to the paper feed roller shaft 3*a* by bonding device, etc., it is made possible to provide predetermined twist suppression effect by the bonding effect.

By the way, the rubber member 15*b* is wound around the outer peripheral portion of the paper feed auxiliary roller 15 as described above. In the embodiment, the rubber member 15*b* is made of EPDM (ethylene propylene rubber) like the rubber member 3*b* wound around the outer peripheral portion of the paper feed roller 3; the EPDM comprises an additive added to the EPDM of the rubber member 3*b* described above, so that the tensile strength of the rubber member 15*b* is improved. The reason why the tensile strength of the rubber member 15*b* wound around the paper feed auxiliary roller 15 is improved more than the rubber member 3*b* wound around the paper feed roller 3 is as follows:

To being with, it is desirable that an elastic member should be wound around the outer peripheral portion of the paper feed auxiliary roller 15 from the viewpoint of protection of the print side of paper P as described above, but it is not desirable to use an elastic member of the same width as the paper feed roller 3 from the view point of cost reduction. However, if an elastic member having a smaller width than that of the paper feed roller 3 is used, the whole strength is degraded and the following problem occurs: The guide member 13 for smoothly guiding the paper P downstream is placed at the position opposed to the paper feed auxiliary roller 15 as shown in FIG. 7 and the paper feed auxiliary roller 15 is placed between the two guide faces 13*a* and 13*a* as shown in FIG. 6. Therefore, if multiple sheets of paper P are fed at a time in such a composition, the sheet bundle of the paper P is sandwiched between the paper feed auxiliary roller 15 and the two guide faces 13*a* and 13*a*, namely, a paper jam occurs.

If the paper feed unit 1 is configured to perform control so as to stop the paper feed roller 3, for example, when a paper jam occurs, the drive motor 169 (see FIG. 4) for rotating the paper feed roller 3 is in an energized state and thus when the jammed paper bundle is drawn out, the paper feed roller shaft 3*a* does not rotate and therefore if the paper bundle is drawn out by force in the state, the rubber member 15*b* may be torn.

Therefore, as the tensile strength of the rubber member 15*b* wound around the paper feed auxiliary roller 15 is improved, if a paper jam occurs between the paper feed auxiliary roller 15 and the two guide faces 13*a* and 13*a* and the jammed paper bundle is drawn out by force, the rubber member 15*b* wound around the paper feed auxiliary roller 15 can be prevented from being torn and at the same time, the width direction dimension is decreased, so that the cost can be reduced.

In the embodiment, the paper feed auxiliary roller 15 has a smaller width than the paper feed roller 3 as shown in FIG. 6, whereby the cost of the rubber member 15*b* is reduced and the space surrounding the paper feed auxiliary roller 15 is saved and thus when the paper feed unit 1 is joined to the carriage unit 120 (see FIG. 1), the flexibility of placement of the components of the carriage unit 120 is enhanced. However, the roller main body 15*c* of the paper feed auxiliary roller 15 has a width equal to or more than that of the paper feed roller 3 and the width of the rubber member 15*b* wound around the outer peripheral portion is unchanged, whereby the twist suppression effect of the paper feed roller shaft 3*a* described above can be provided furthermore and at the same time, it is made possible to provide the various advantages of the paper feed auxiliary roller 15 described above. The elastic members wound around the outer peripheral portions of the paper feed roller 3 and the paper feed auxiliary roller 15 are not limited to those in the embodiment (rubber members (EPDM)); any other material, such as butyl rubber, may be used. That is, any material may be used if it can provide a friction coefficient for enabling paper P to be fed normally as the elastic member of the paper feed roller 3 or it protects the print side of paper P and is at low cost as the elastic member of the paper feed auxiliary roller 15.

Next, paper press members 14 that can be rotated clockwise and counterclockwise in FIG. 7 with a rotation shaft 14*a* as the center are placed at positions opposed to the hopper 6 in FIG. 7 (in the embodiment, two paper press members are placed with the paper feed roller 3 between although not shown). Each paper press member 14 serves a function of lightly pressing sheets of paper P stacked on the hopper 6 from above under its own weight, thereby preventing floating up of the sheets of paper P stacked on the hopper 6. The paper return levers 12 rotated by a cam mechanism (not shown) each with a rotation shaft 12*a* as the center are placed below the hopper 6 (in the embodiment, two paper return levers are placed with the paper feed roller 3 between (see FIGS. 6 and 8B)). The paper return levers 12 serve the function of returning paper P staying in the proximity of the separation pad 8 provided for preventing duplicate delivery of paper P to the top of the hopper 6 and performing the paper feed operation of the next sheet of paper P normally, as described above.

The description of the detailed configuration of the paper feed unit 1 is now complete.

<Configuration of Hopper Release Device>

Figure 10:
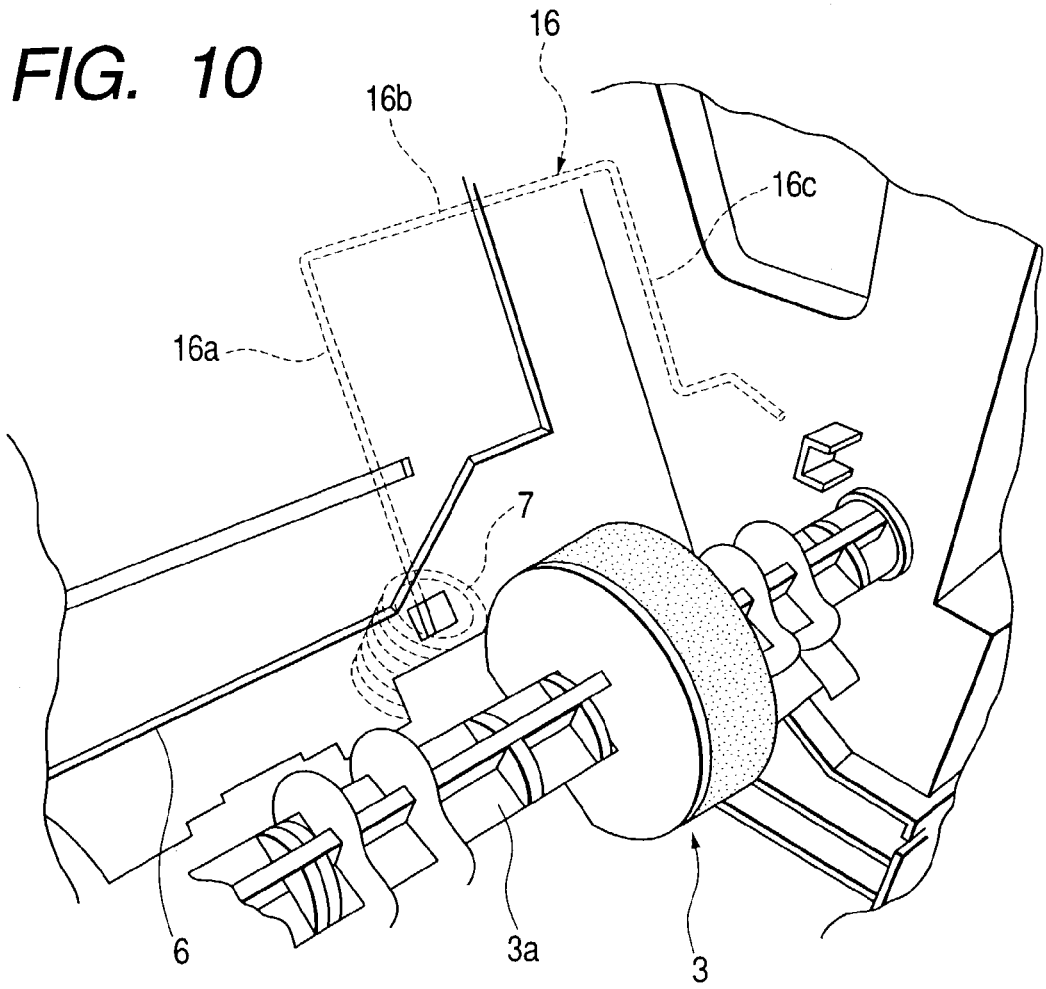
FIG. 10 is a perspective view (partially enlarged view) of the paper feeder according to the invention.
Figure 11:
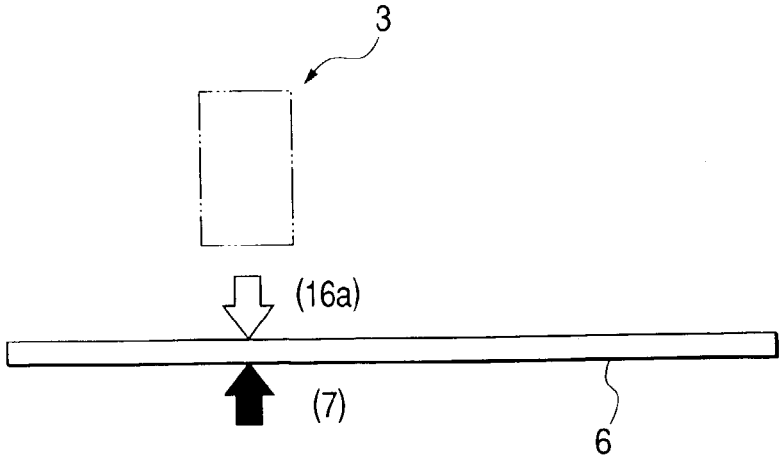
FIG. 11 is a schematic drawing to show the action position of an external force acting on a hopper 6.
Figure 12A:
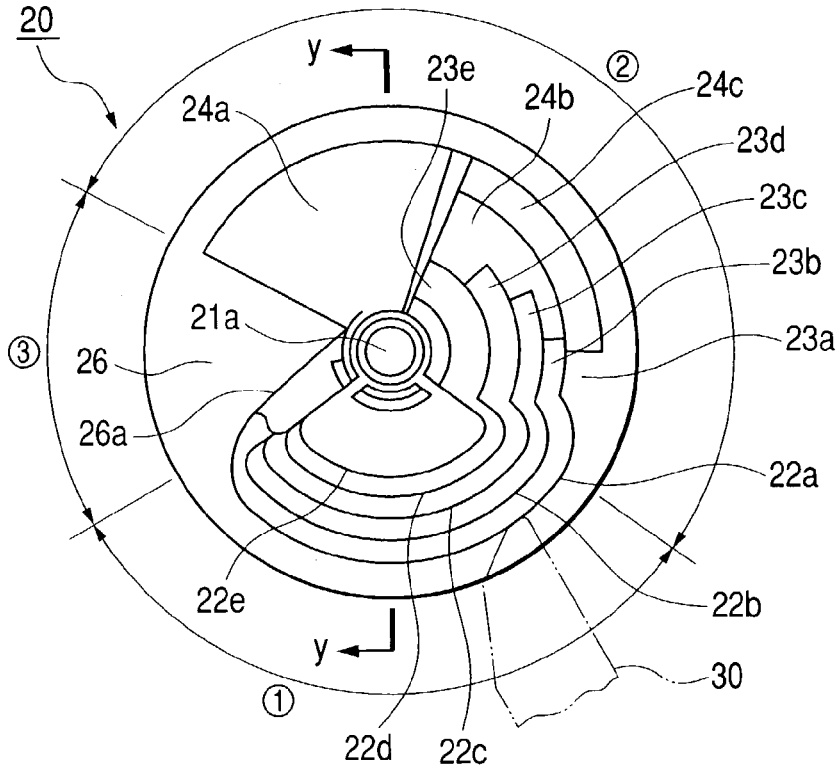
FIG. 12A is a front view of a rotary cam and FIG. 12B is a sectional view taken on line y—y in FIG. 12A.
Figure 12B:
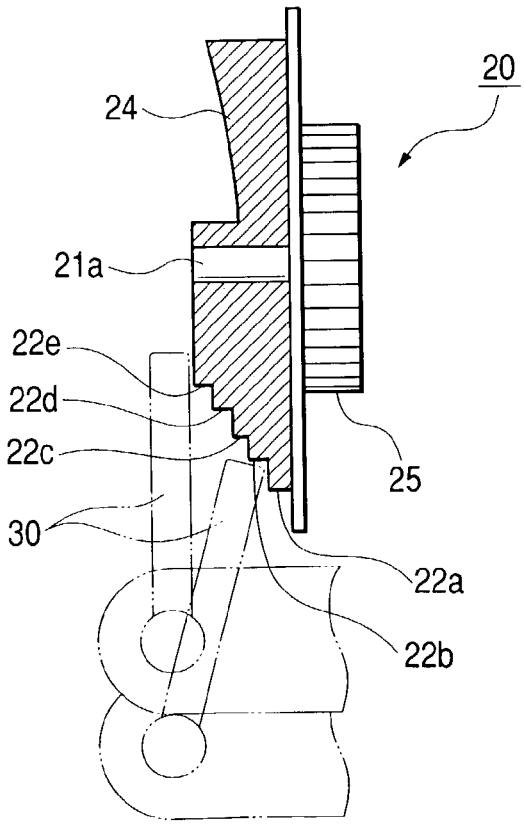
Figure 13A:
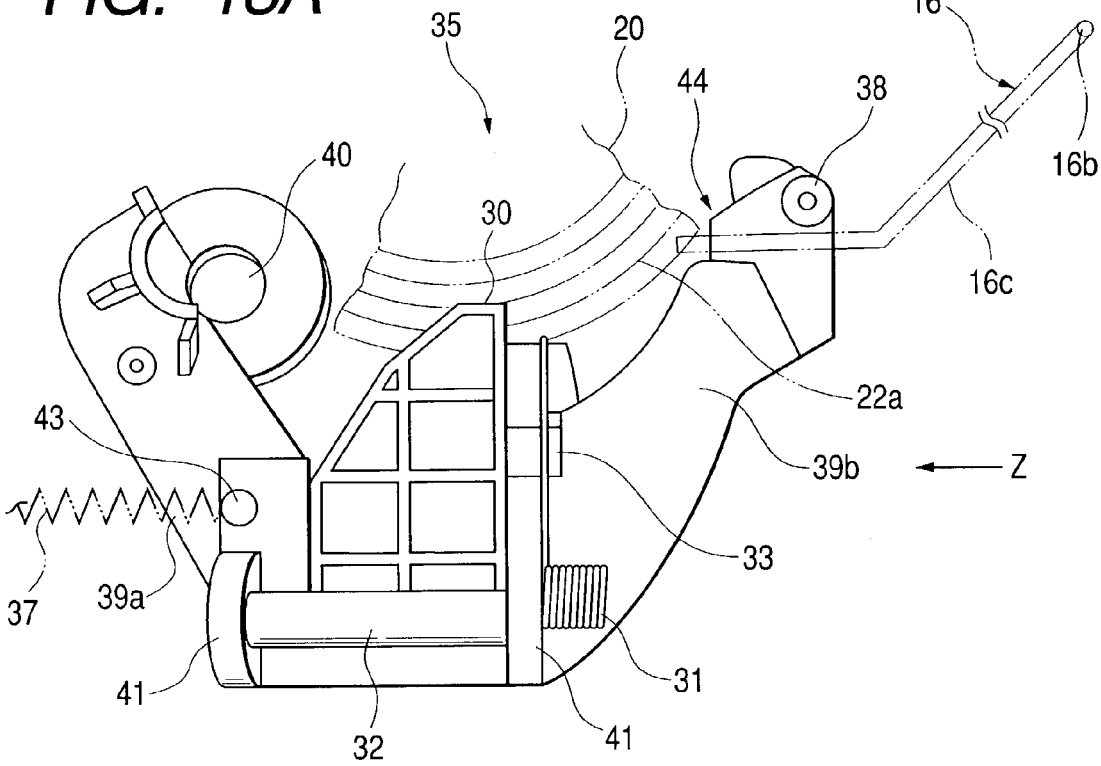
FIG. 13A is a front view of a cam lever holder and FIG. 13B is a side view of the cam lever holder.
Figure 13B:
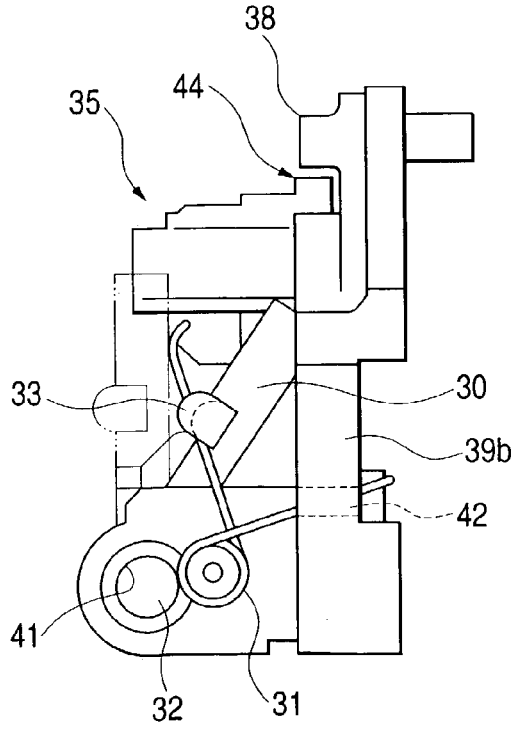

Next, the configuration of the hopper release device for rotating the hopper 6 in a direction in which the hopper 6 is brought away from the paper feed roller 3 will be discussed with reference to FIGS. 10 to 13B and other accompanying drawings whenever necessary. FIG. 10 is a partially enlarged perspective view of the paper feed unit 1 and FIG. 11 is a schematic drawing to show the action position of an external force acting on the hopper 6. FIG. 12A is a front view of a rotary cam 20, FIG. 12B is a sectional view taken on line y—y in FIG. 12A, FIG. 13A is a front view of a cam lever holder 35, and FIG. 13B is a side view of the cam lever holder 35 (a z arrow view in FIG. 13A).

The hopper release device is placed on the right side of the paper feed unit 1 (the front of FIG. 5, the right of FIG. 6), as described above. In FIG. 5, a transmission gear 11 is attached to the right end of the paper feed roller shaft 3*a*, and the transmission gear 11 and a gear part 25 (see FIG. 12B) formed on the rear of a rotary cam 20 attached for rotation by a rotation shaft 21 mesh with each other, whereby the rotary cam 20 is rotated. That is, the rotary cam 20 is rotated with rotation of the paper feed roller 3, and the hopper release device does not have its own drive source and is formed at low cost. The transmission gear 11 meshes directly with the rotary cam 20 and has the same number of teeth as the gear part 25. Therefore, as the paper feed roller 3 rotates once clockwise, the rotary cam 20 rotates once counterclockwise.

On the other hand, a cam lever 30 and a cam lever holder 35 that can swing with rotation of the rotary cam 20 are placed below the rotary cam 20, and the hopper release device described below in detail is configured so as to perform the engagement operation in the order of the rotary cam 20, the cam lever 30, and the cam lever holder 35. The hopper release device is configured so as to rotate a release bar 16 (see FIG. 10) engaging the rear of the hopper 6 (the right of FIG. 7) by the swing operation of the cam lever holder 35, thereby rotating the hopper 6. The hopper release device has been outlined.

The structure and function of the release bar 16 placed on the rear of the hopper 6 will be discussed. As shown in FIG. 10, the release bar 16 is shaped roughly like angular U and consists of a first shaft part 16*b* extending in the length direction of the hopper 6 (width direction of paper P), a second shaft part 16*a* extending vertically from one end of the first shaft part 16*b* to the proximity of is the helical compression spring 7, and a third shaft part 16*c* extending roughly parallel with the second shaft part 16*a* from an opposite end of the first shaft part 16*b*.

As shown in FIG. 7, the release bar 16 has the first shaft part 16*b* journaled by a bearing part 18 placed above a subframe 19 shaped like V as a side view, whereby the second shaft part 16*a* and the third shaft part 16*c* can be rotated clockwise and counterclockwise in FIG. 7 with the first shaft part 16*b* as a rotation shaft.

On the other hand, the hopper 6 is formed on the rear with an engagement part 6*c* (see FIG. 7) that the tip of the second shaft part 16*a* engages, and the cam lever holder 35 described later in detail is formed with a recess part 44 by a projection 38, as a "hopper action section" into which the folded tip of the third shaft part 16*c* is fitted, as shown in FIGS. 13A and 13B. When the cam lever holder 35 is rotated clockwise and counterclockwise in FIG. 13A, the release bar 16 is rotated with the first shaft part 16*b* as a rotation shaft, whereby the hopper 6 is swung. This device that the cam lever holder 35, the cam lever 30, and the rotary cam 20 make up "release bar rotation device" for rotating the release bar 16.

By the way, the disposition position of the engagement part of the release bar 16 and the hopper 6, namely, the engagement part 16*c* and the placement position of the helical compression spring 7 are roughly the same, as shown in FIGS. 7 and 10 and therefore the action point of the force given by the release bar 16 to the hopper 6 and the action point of the force given by the helical compression spring 7 to the hopper 6 are placed at roughly the same position in a plan view of the hopper 6. Therefore, a bending moment scarcely occurs in the hopper 6 and deformation of the hopper 6 is prevented, so that it is made possible to maintain the normal paper feed operation.

More particularly, as shown in FIG. 11, the hopper 6 is made of a plate-like body long in the width direction of paper P and thus if the action point of the force given by the release bar 16 (second shaft part 16*a*) to the hopper 6 (white arrow in FIG. 11) and the action point of the force given by the helical compression spring 7 to the hopper 6 (black arrow in FIG. 11) do not match on the plane of the hopper 6 (side-to-side direction of FIG. 11 and surface and back direction of the plane of the figure), a bending moment occurs in the hopper 6 and accordingly the hopper 6 is bent temporarily or will be bent in the future. If the hopper 6 is thus bent, various defective conditions such that the maximum number of set sheets of paper P is decreased and that a skew occurs when paper P is transported occur.

However, in the paper feed unit 1, as described above, the action point of the force given by the release bar 16 to the hopper 6 and the action point of the force given by the helical compression spring 7 to the hopper 6 are placed at roughly the same position on the plane of the hopper 6 as shown in FIG. 11. Therefore, a bending moment scarcely occurs in the hopper 6 and deformation of the hopper 6 is prevented, so that it is made possible to maintain the normal paper feed operation, and the force action points match on the hopper 6 and, thus the high-speed swing operation of the hopper 6 can be performed stably.

Next, the rotary cam 20, the cam lever 30, and the cam lever holder 35 as the release bar rotation device for rotating the release bar 16 will be discussed.

To being with, as shown in FIG. 12A, the rotary cam 20 is shaped like a disk rotating with a rotation shaft 21 (see FIG. 5) inserted into a shaft hole 21*a* in a front view and comprises a stepwise cam part formed so as to protrude stepwise toward the shaft hole 21*a* from the outer periphery (the range indicated by area (1) in FIG. 12A). The stepwise cam part is made up of fan-shaped cams 22*a* to 22*e* each forming a fan shape in the front view for engaging the cam lever 30 on the outer peripheral surface. Formed contiguous with the fan-shaped cam 22*a* is a cam lever guide part consisting of a guide face 23*a* and fan-shaped guide faces 23*b* to 23*e* for guiding the cam lever 30 to the outer peripheral surfaces of the fan-shaped cams 22*a* to 22*e* and guide slopes 24*a* to 24*c* for guiding the cam lever 30 to the guide face 23*a* and the fan-shaped guide faces 23*b* to 23*e*, the cam lever guide part for guiding the cam lever 30 to the outer peripheral surface of any of the fan-shaped cams (22*a* to 22*e*) corresponding to the stack amount of sheets of paper P (the range indicated by area (2) in FIG. 12A).

The guide face 23*a* and the fan-shaped guide faces 23*b* to 23*e* are positioned to the inner peripheral side of the rotary cam 20 stepwise from the outer peripheral surfaces of the fan-shaped cams 22*a* to 22*e*, so that the cam lever 30, for example, on the fan-shaped guide face 23*c* engages the outer peripheral surface of the fan-shaped cam 22*b* as the rotary cam 20 is rotated counterclockwise in FIG. 12A from the state. The fan-shaped guide faces 23*b* to 23*e* are formed so that phases (start points of circular arcs) differ spirally as shown in FIG. 12A.

The guide slopes 24*a* to 24*c* serve the function of guiding the cam lever 30 positioned in a non-cam part 26 (described later) to the guide face 23*a* and the fan-shaped guide faces 23*b* to 23*e*. The guide slope 24*a* protrudes gradually clockwise in the rotary cam 20 as shown in FIG. 5 and becomes a diametrically uniform height (in FIG. 12B, the left is high side) and then is connected to the fan-shaped guide face 23*e* roughly at the same height on the inner peripheral side and is connected to the guide slope 24*b* dropping to the fan-shaped guide faces 23*b*, 23*c*, 23*d* at lower positions than the fan-shaped guide face 23*e* in the diametrical center and is connected to the guide slope 24*c* dropping to the fan-shaped guide face 23*a* on the outer peripheral side.

Next, the non-cam part 26 made of a flat disk face is placed contiguous with the fan-shaped cams 22*a* to 22*e* (the range indicated by area (3) in FIG. 12A). The non-cam part 26 does not restrain the cam lever 30 in the diametric direction of the rotary cam 20 and therefore the cam lever in an engagement state with the fan-shaped cam 22*a* positioned on the outermost peripheral side, for example, is displaced toward the rotation center of the rotary cam 20 until the top sheet of paper P is pressed against the paper feed roller 3 by the urging force of the helical compression spring 7 shown in FIG. 7 when the rotary cam 20 is rotated counterclockwise in FIG. 12A from the engagement state of the cam lever 30 with the fan-shaped cam 22*a* and enters the area of the non-cam part 26. In contrast, the cam lever 30 in the area of the non-cam part 26 is guided to the outer peripheral surface of the fan-shaped cam 22*a* positioned on the outermost peripheral side while it is guided by a cam face 26*a* smoothly continued to the outer peripheral surface of the fan-shaped cam 22*a* when the rotary cam 20 is rotated clockwise in FIG. 12A from the state in which the cam lever 30 is in the area of the non-cam part 26.

Next, in FIGS. 13A and 13B, the cam lever holder 35 is shaped like an arm consisting of an arm part 39*a* extending from a shaft hole 40 into which a rotation shaft 36 (see FIG. 5) is inserted and an arm part 39*b* diverted from the arm part 39*a* and extending slantingly upward, and is attached to the paper feed unit frame 2 for rotation with the shaft hole 40 as the center. The cam lever holder 35 is provided with a spring hook part 43 and the paper feed unit frame 2 is also provided with a similar spring hook part (not shown) and an extension spring 37 is placed on the spring hook parts (see FIG. 5). The extension spring 37 exerts such a spring force rotating the cam lever holder 35 clockwise in FIGS. 13A and 13B, whereby the projection 38 is always in contact with the release bar 16.

In FIG. 13A, as the cam lever holder 35 is rotated clockwise in the figure, the release bar 16 (third shaft part 16*c*) is rotated counterclockwise in the figure and accordingly the hopper 6 is rotated in a direction in which it is brought away from the paper feed roller 3. At this time, the cam lever holder 35 rotates the hopper 6 against the spring force of the helical compression spring 7 (see FIG. 7). On the other hand, as the cam lever holder 35 is rotated counterclockwise in FIG. 13A, the release bar 16 (third shaft part 16*c*) is rotated clockwise in the figure and accordingly the hopper 6 is rotated in a direction in which it is pressed against the paper feed roller 3. At this time, the release bar 16 and the cam lever holder 35 are rotated by the spring force of the helical compression spring 7 (see FIG. 7).

The cam lever 30 has a rotation shaft 32 journaled by bearing parts 41 and 41 formed in the cam lever holder 35 and can be swung in the axial direction of the rotary cam 20 as indicated by phantom lines in FIGS. 12B and 13B. The cam lever 30 is provided with a spring hook part 33 and the cam lever holder 35 is provided with a hole part 42 and a torsion coil spring 31 is placed between the spring hook part 33 and the hole part 42. Therefore, the cam lever 30 is pulled to the rotary cam 20 by the spring force of the torsion coil spring 31 and is always in contact with the rotary cam 20.

The engagement operation of the rotary cam 20, the cam lever 30, and the cam lever holder 35 described above will be discussed. To begin with, in FIG. 12A, the case where the cam lever 30 is pressed against the outer peripheral surface of the fan-shaped cam 22*a* as indicated by the phantom line and numeral 30 and the rotary cam 20 rotates once (360 degrees) from the state will be discussed.

When the cam lever 30 is on the fan-shaped cam 22*a*, the cam lever holder 35 is placed at a position where it is rotated most clockwise as seen in FIG. 13A, and therefore the hopper 6 is placed most away from the paper feed roller 3. When the rotary cam 20 is rotated counterclockwise in FIG. 12A, the cam lever 30 is detached from the fan-shaped cam 22*a*, enters the area of the non-cam part 26 (area (3)), and is displaced toward the rotation center of the rotary cam 20. As the cam lever 30 is thus displaced in the center direction of the rotary cam 20, the cam lever holder 35 is rotated counterclockwise in FIG. 13A and thus the hopper 6 is rotated in the direction in which it is pressed against the paper feed roller 3 by the urging force of the helical compression spring 7.

Here, if the stack amount of sheets of paper P set on the hopper 6 is large, the swing angle of the hopper 6 is lessened. Therefore, in this case, the cam lever 30 is small displaced toward the rotation center of the rotary cam 20 if it is detached from the fan-shaped cam 22*a*. On the other hand, if the stack amount of sheets of paper P set on the hopper 6 is small, the swing angle of the hopper 6 is increased. Therefore, in this case, the cam lever 30 is largely displaced toward the rotation center of the rotary cam 20 after it is detached from the fan-shaped cam 22*a*.

As the rotary cam 20 is further rotated counterclockwise in FIG. 12A, the cam lever 30 enters the cam lever guide part (area (2)) and starts to engage the guide slope 24*a*. At this time, although the cam lever 30 is not displaced in the diametric direction of the rotary cam 20, it is swung in the axial direction of the rotary cam 20 (see FIG. 12B) and is guided to any of the fan-shaped guide face 23*e*, the guide slope 24*b* (and then the fan-shaped guide face 23*b*–23*d*), or the guide slope 24*c* (and then the guide face 23*a*).

Here, what position the cam lever 30 is at in the diametric direction of the rotary cam 20 depends on the stack amount of sheets of paper P set on the hopper 6 as described above and thus which of the fan-shaped guide face 23*e*, the guide slope 24*b* (and then the fan-shaped guide face 23*b*–23*d*), and the guide slope 24*c* (and then the guide face 23*a*) the cam lever 30 is guided to depends on the stack amount of sheets of paper R Therefore, for example, if the stack amount of sheets of paper P is minimum, the cam lever 30 is guided to the fan-shaped guide face 23*e*; if the stack amount of sheets of paper P is maximum, the cam lever 30 is guided to the guide slope 24*c* (and then the guide face 23*a*).

Next, as the rotary cam 20 is further rotated, the cam lever 30 climbs to the outer peripheral surface of the fan-shaped cam initially positioned on the outer peripheral side (fan-shaped cam 22*a*–22*e*) from the diametric position in the rotary cam 20 at the time. That is, the cam lever 30 is small displaced in the diametric direction of the rotary cam 20 (direction toward the outer periphery from the rotation center of the rotary cam 20, and the cam lever holder 35 is small rotated clockwise in FIG. 13A. Therefore, the hopper 6 is a little swung in the direction in which it is brought away from the paper feed roller 3. Thus, the top sheet of paper P pressed against the paper feed roller 3 is placed in a state in which it is a little away from the paper feed roller 3 (free state).

The engagement operation of the rotary cam 20, the cam lever 30, and the cam lever holder 35 has been described. Thus, the hopper release device has three modes of "large release mode" for rotating the hopper 6 so as to bring the hopper 6 most away from the paper feed roller 3 (state in which the cam lever 30 engages the outer peripheral surface of the fan-shaped cam 22*a* positioned on the outermost peripheral side), "non-release mode" for pressing the hopper 6 against the paper feed roller 3 (state in which the cam lever 30 is in the non-cam part 26 (area (3)) or the cam lever guide part (area (2)), and "small release mode" for rotating and holding the hopper 6 so that the top sheet of paper P and the paper feed roller 3 are a little away from each other (state in which the cam lever 30 is moved from area (2) to area (1)), and can execute any of the modes as desired by controlling rotation of the rotary cam 20 (paper feed roller shaft 3*a*).

The number of steps of the stepwise cam parts (fan-shaped cams 22*a* to 22*e*) formed on the rotary cam 20 is five in the embodiment. However, as seen from the description made above, as the number of steps is increased, it is made possible to control the hopper 6 more finely in response to the stack amount of sheets of paper P, needless to say.

Figure 14:
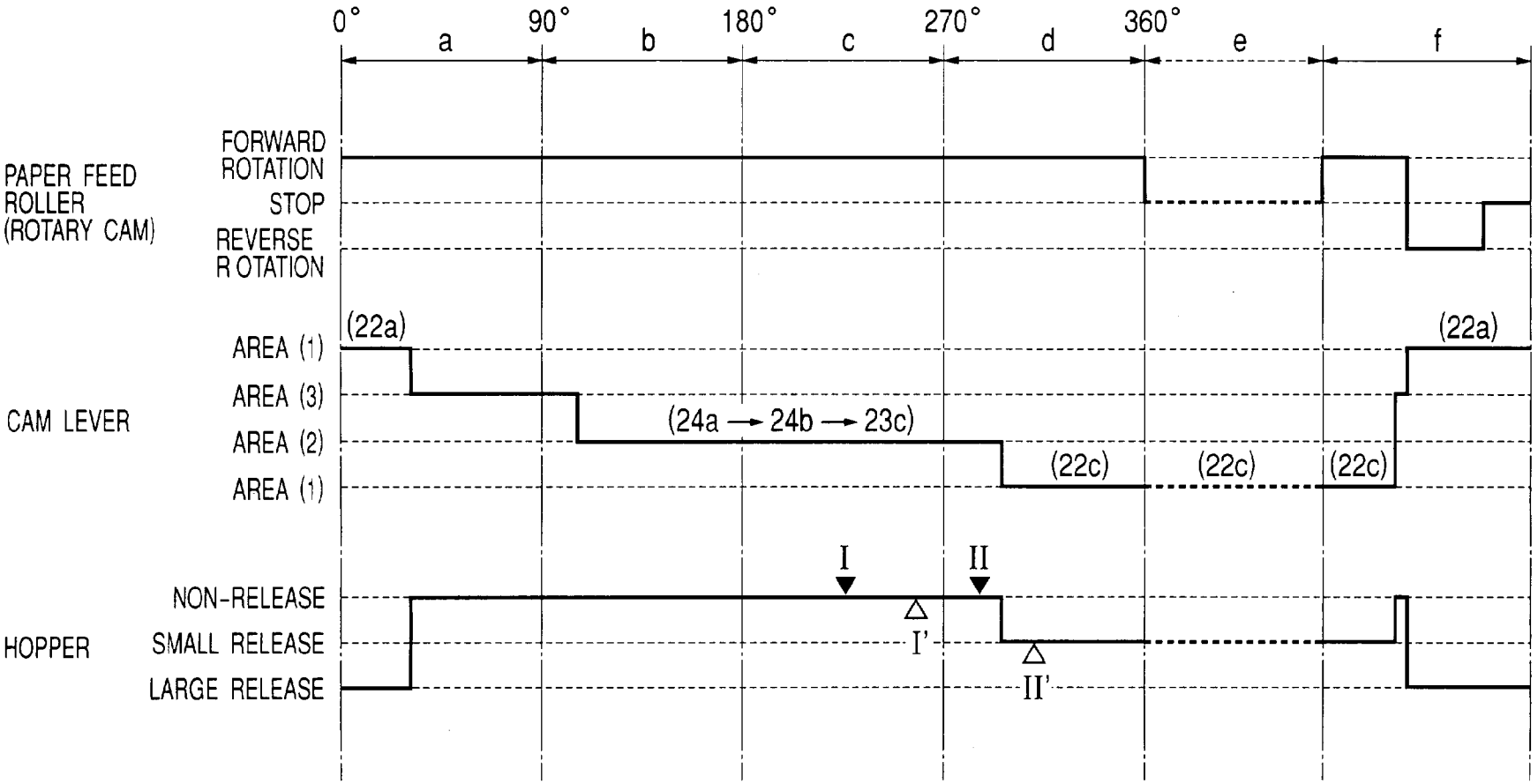
FIG. 14 is a timing chart to show the operation transition of a paper feed roller, a cam lever, and a hopper.
Figure 15A:
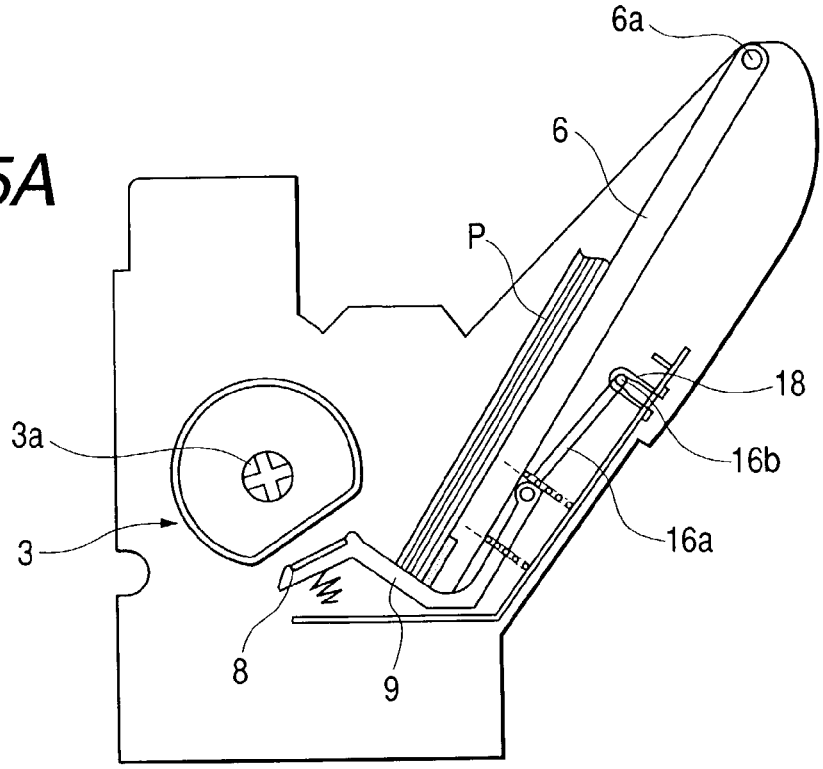
FIGS. 15A and 15B are schematic representations during the paper feed operation of the paper feeder according to the invention.
Figure 15B:
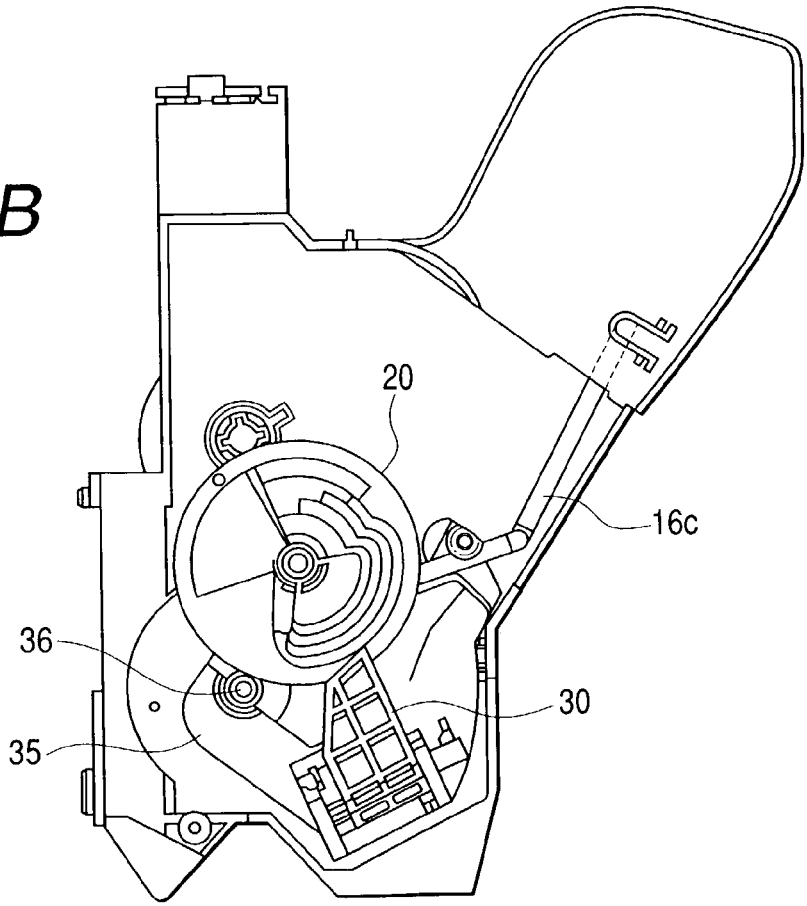

Next, the actual paper feed control in the paper feed unit 1 and the advantages of the hopper release device will be discussed with reference to FIGS. 14 to 22B. FIG. 14 is a timing chart to show the operation transition of the paper feed roller 3, the cam lever 30, and the hopper 6 and FIGS. 15A to 22B are schematic representations to show the state of the paper feed roller 3, the cam lever 30, and the hopper 6 at the timings in the timing chart of FIG. 14; (A) mainly shows the positional relationship between the paper feed roller 3 and the hopper 6 and (B) mainly shows the engagement state of the cam lever 30 and the rotary cam 20.

AREAS (1), (2), and (3) shown in FIG. 14 correspond to the areas of the rotary cam 20 shown in FIG. 12A. Numerals of the cam lever 30 shown on the chart denote the fan-shaped cams 22*a* to 22*e* or the guide face 23*a* and the fan-shaped guide faces (23*b* to 23*e*) that the cam lever 30 engages. Further, NON-RELEASE of the hopper 6 device the hopper 6 in the state in which paper P set on the hopper 6 is pressed against the paper feed roller 3 according to the non-release mode; SMALL RELEASE device the hopper 6 in the state in which the top sheet of paper P set on the hopper 6 is a little away from the paper feed roller 3 according to the small release mode; and LARGE RELEASE device the hopper 6 in the state in which the hopper 6 is most away from the paper feed roller 3 according to the large release mode. FORWARD ROTATION of the paper feed roller 3 device that the paper feed roller 3 is rotated clockwise in FIGS. 15A to 22B, and the rotary cam 20 is rotated counterclockwise in the figures with the forward rotation of the paper feed roller 3.

Figure 16A:
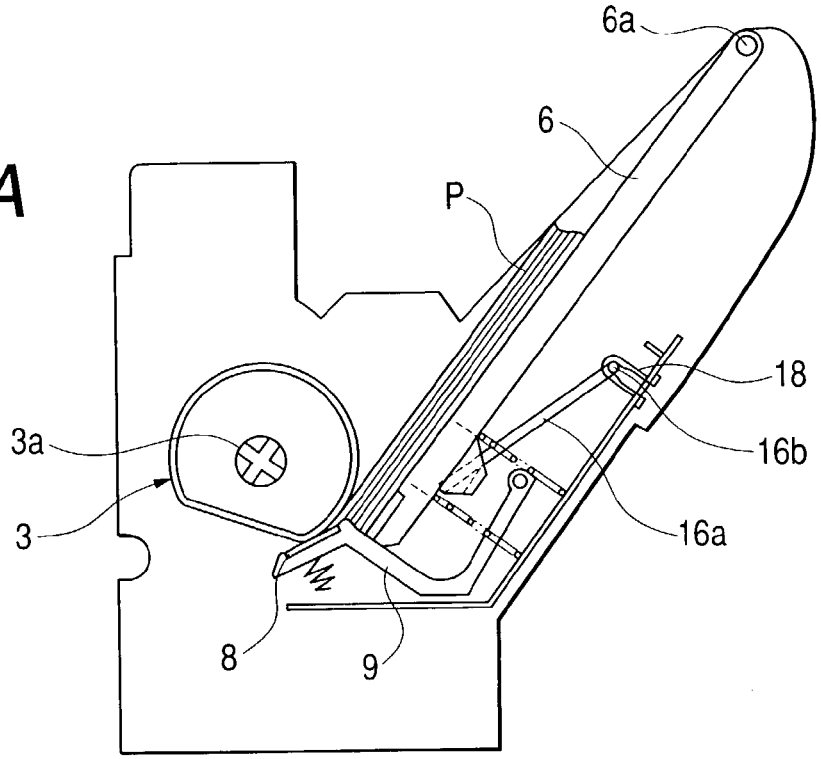
FIGS. 16A and 16B are schematic representations during the paper feed operation of the paper feeder according to the invention.
Figure 16B:
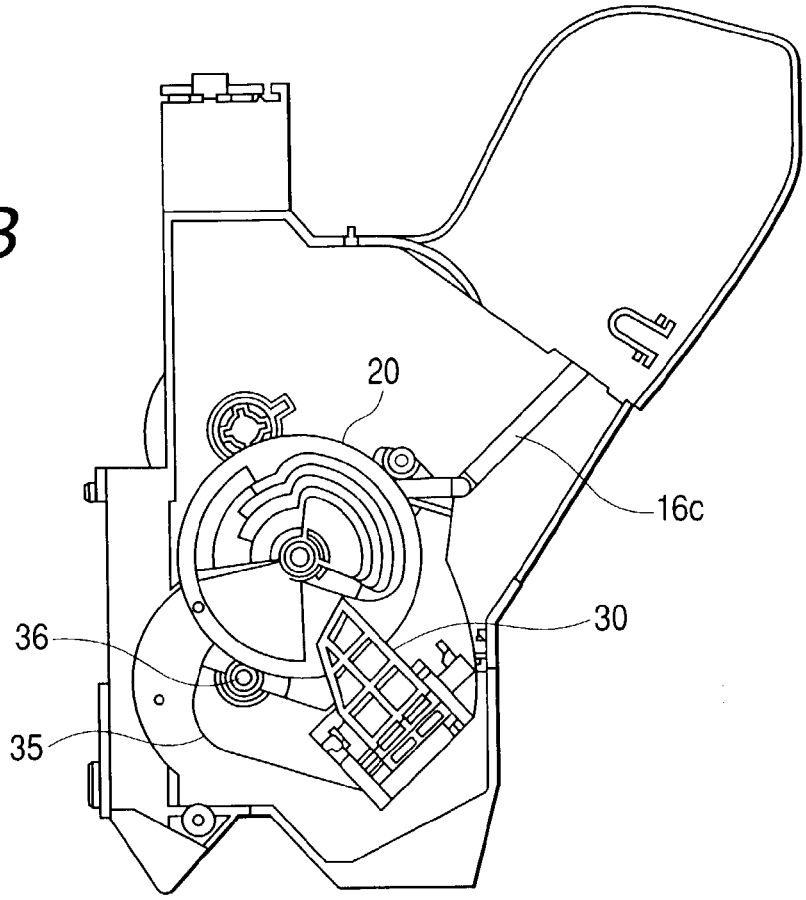
Figure 17A:
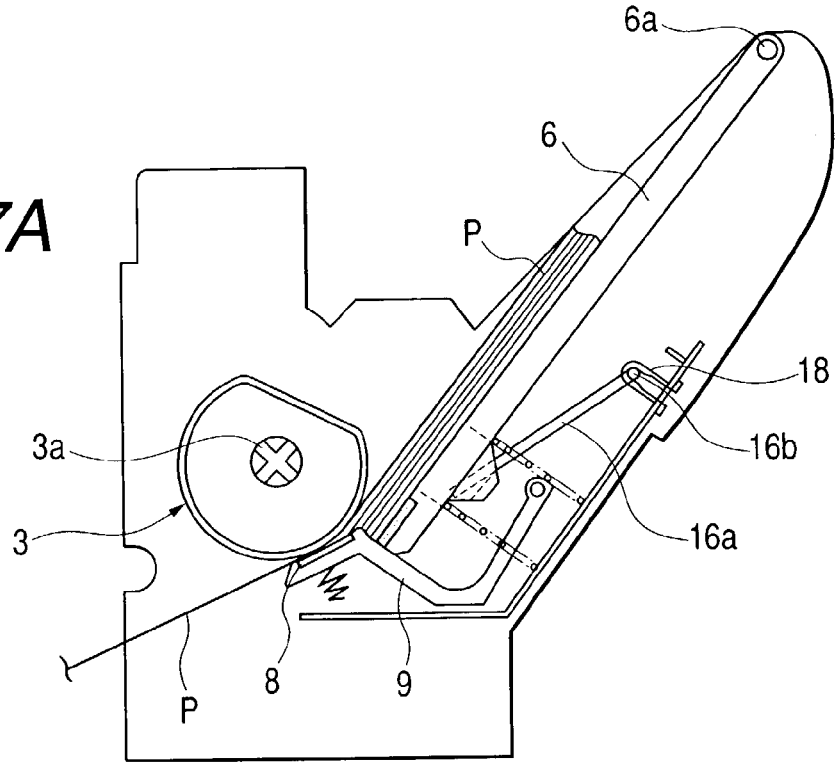
FIGS. 17A and 17B are schematic representations during the paper feed operation of the paper feeder according to the invention.
Figure 17B:
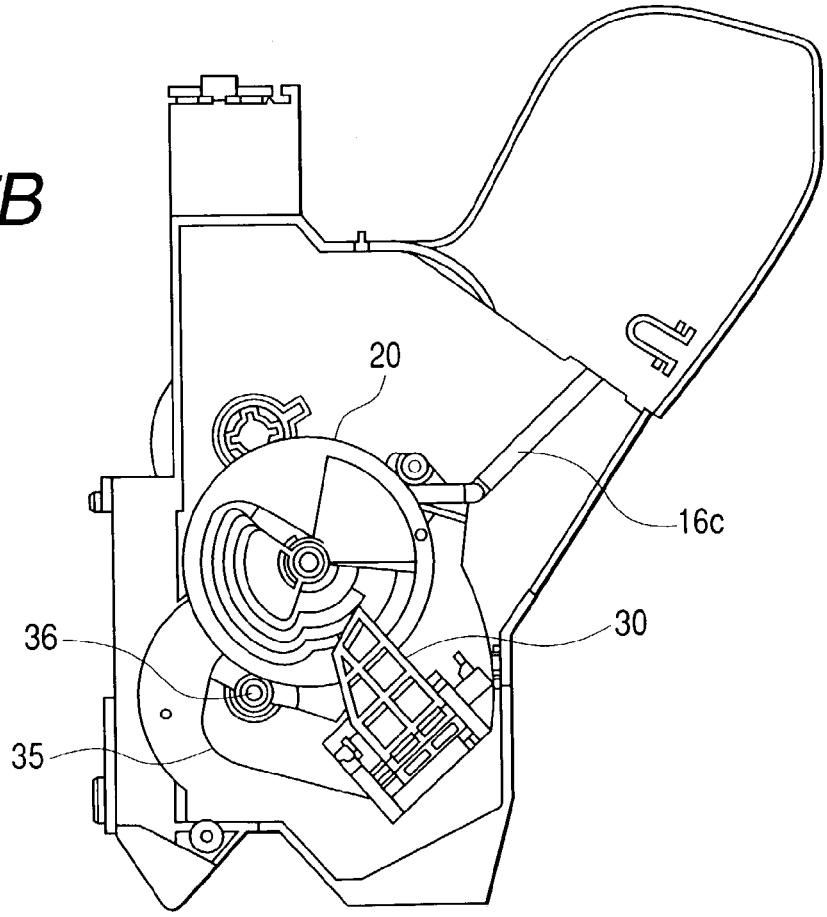
Figure 18A:
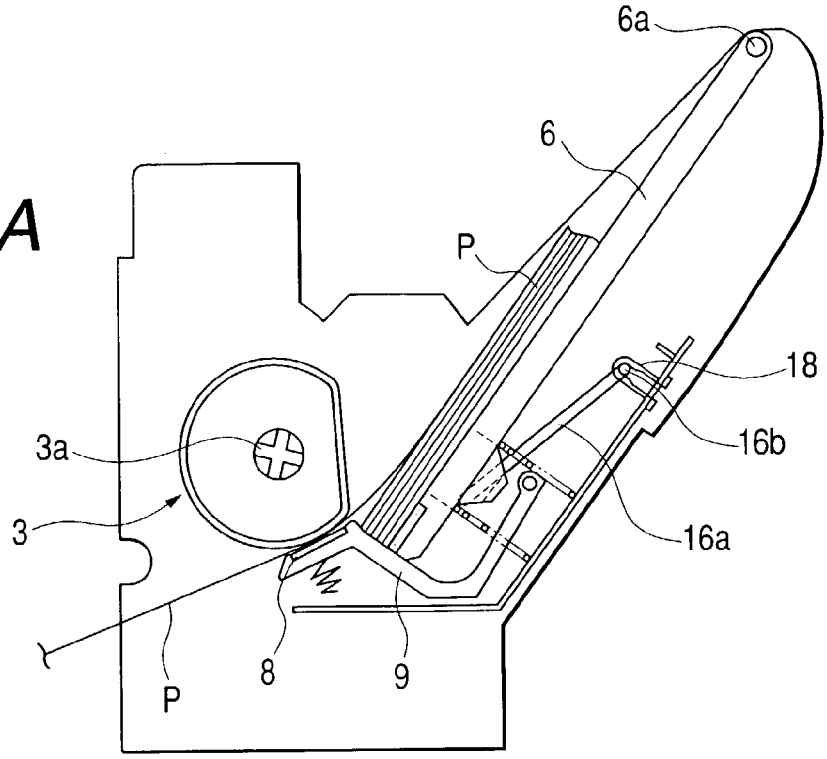
FIGS. 18A and 18B are schematic representations during the paper feed operation of the paper feeder according to the invention.
Figure 18B:
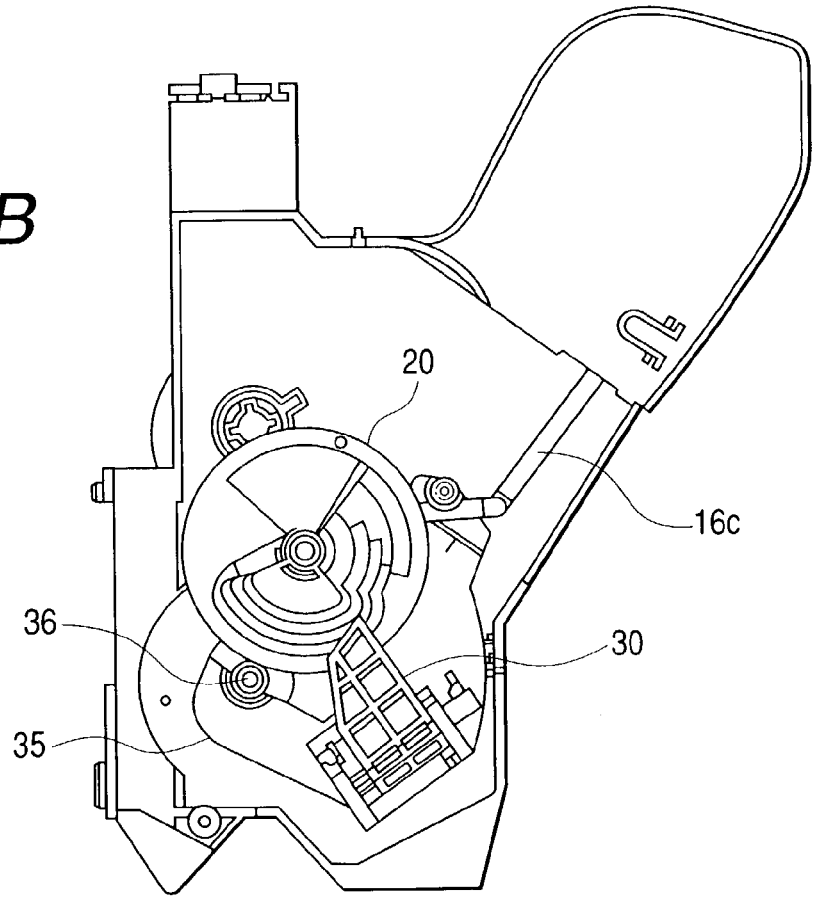

To begin with, at the paper feed start time, the cam lever 30 is on the fan-shaped cam 22*a* (FIG. 15B), the hopper 6 is most away from the paper feed roller 3 (FIG. 15A), and in the state, the paper feed unit 1 is in a nonoperating state in which paper P can be set. When the paper feed roller 3 is forward rotated to perform the paper feed operation from the state, the rotary cam 20 is rotated counterclockwise in the figure, whereby the cam lever 30 is detached from the fan-shaped cam 22*a* and enters the area of the non-cam part 26 (area (3)) (FIG. 16B) and the paper P set on the hopper 6 is pressed against the paper feed roller 3 (FIG. 16A). That is, the hopper release device executes the non-release mode (section a in FIG. 14). As the paper feed roller 3 is rotated, feeding the top sheet of paper P is started.

Next, as the paper feed roller 3 is further forward rotated, the cam lever 30 starts to engage the guide slope 24*a* (cam lever guide part: Area (2)) and is guided to either the guide face 23*a* or the fan-shaped guide face 23*b*–23*d* in response to the stack amount of sheets of paper P set on the hopper 6 (FIG. 17B: In the embodiment, guided to the fan-shaped guide face 23*c* via the guide slope 24*b*). At this time, the paper P set on the hopper 6 remains pressed against the paper feed roller 3 (non-release state) (sections b and c in FIG. 14).

Figure 19A:
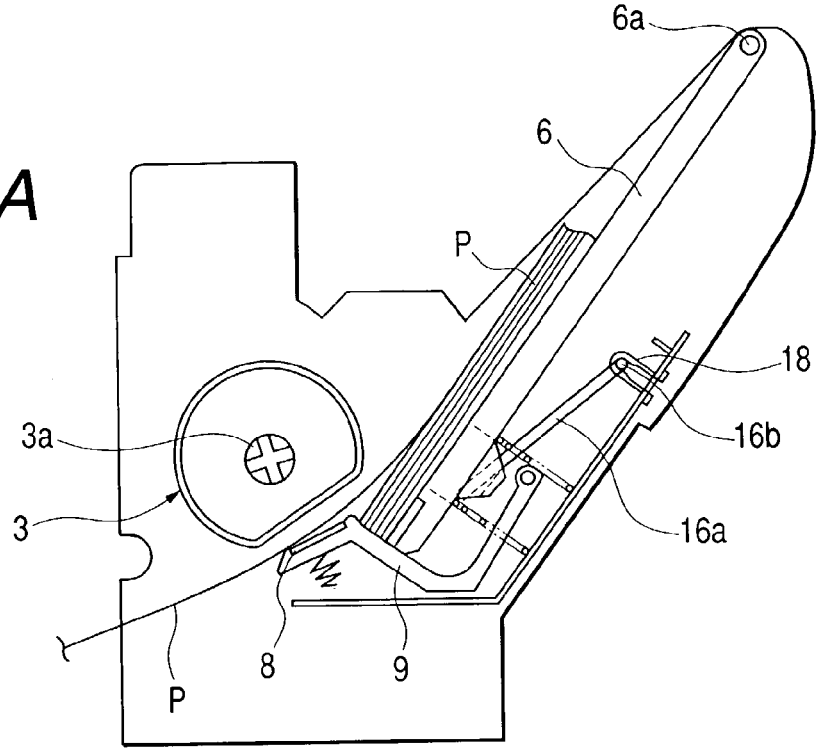
FIGS. 19A and 19B are schematic representations during the paper feed operation of the paper feeder according to the invention.
Figure 19B:
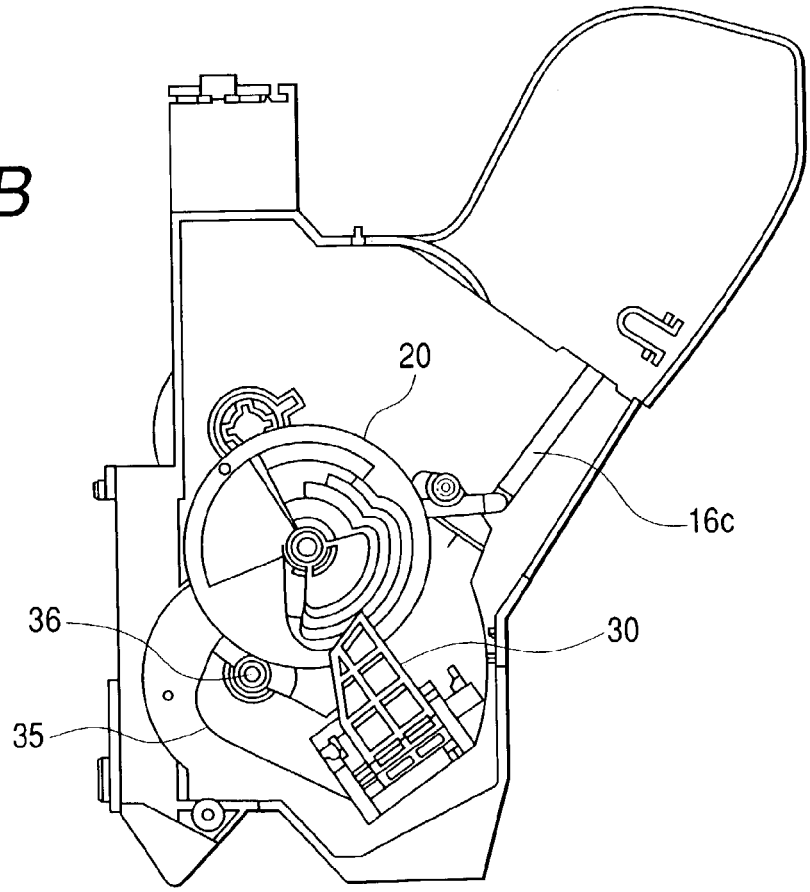
Figure 20A:
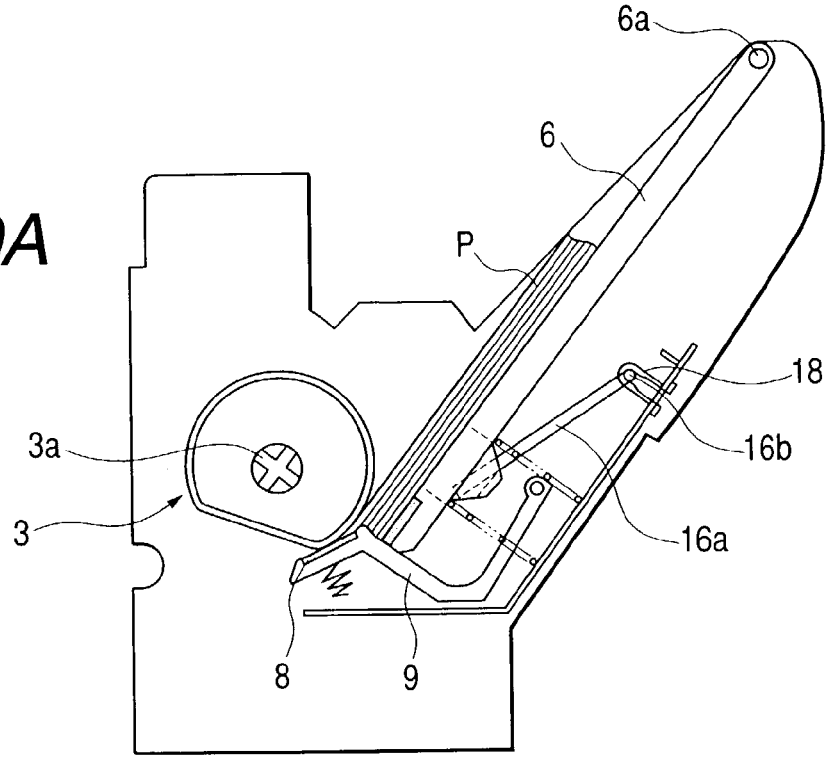
FIGS. 20A and 20B are schematic representations during the paper feed operation of the paper feeder according to the invention.
Figure 20B:
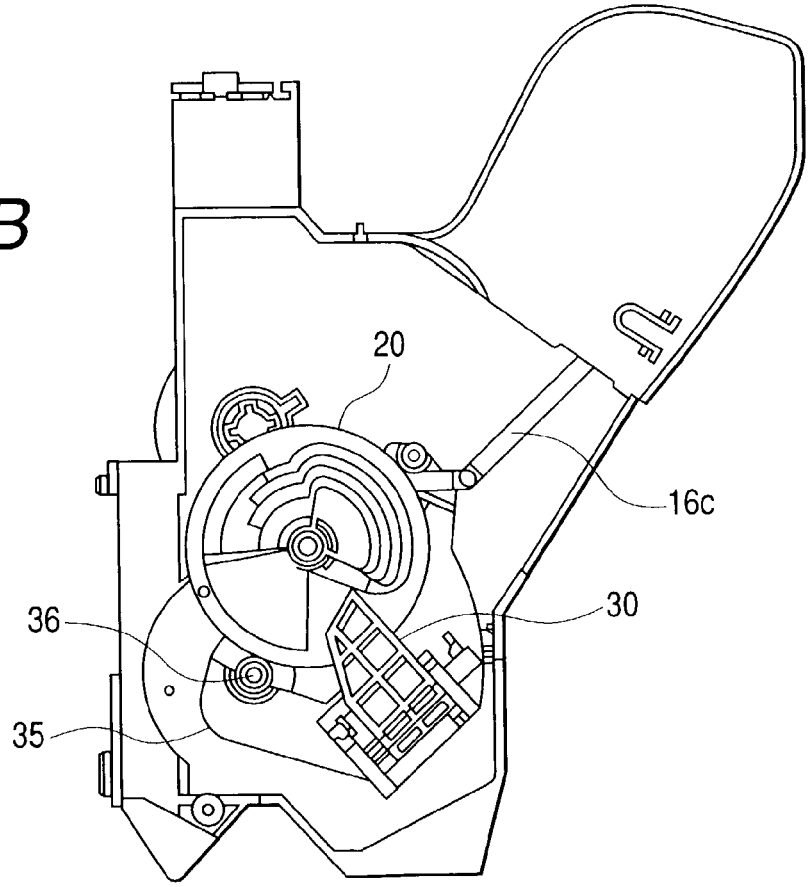
Figure 21A:
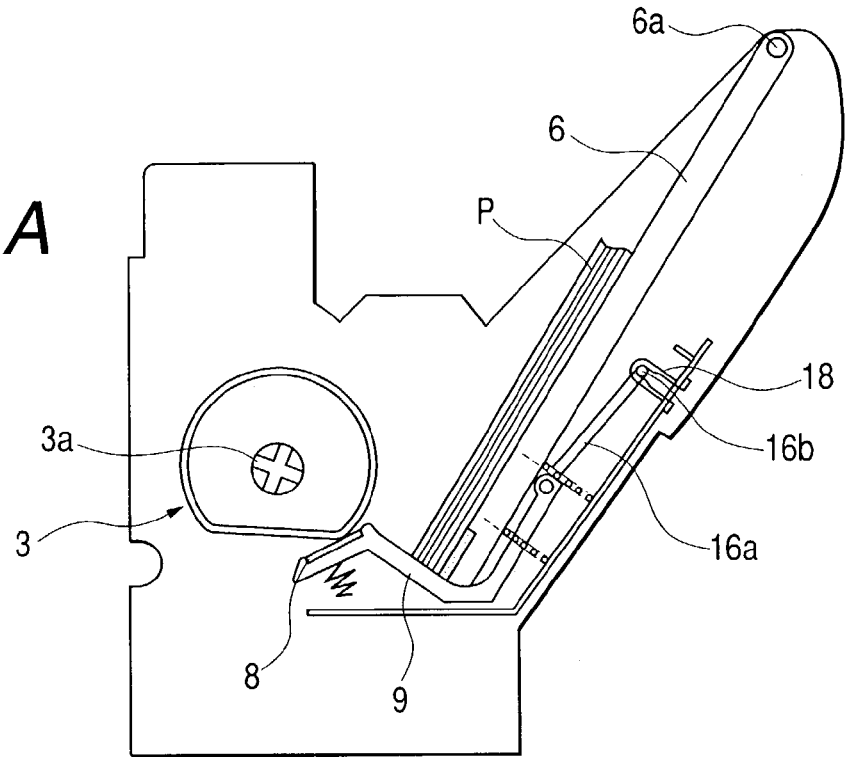
FIGS. 21A and 21B are schematic representations during the paper feed operation of the paper feeder according to the invention.
Figure 21B:
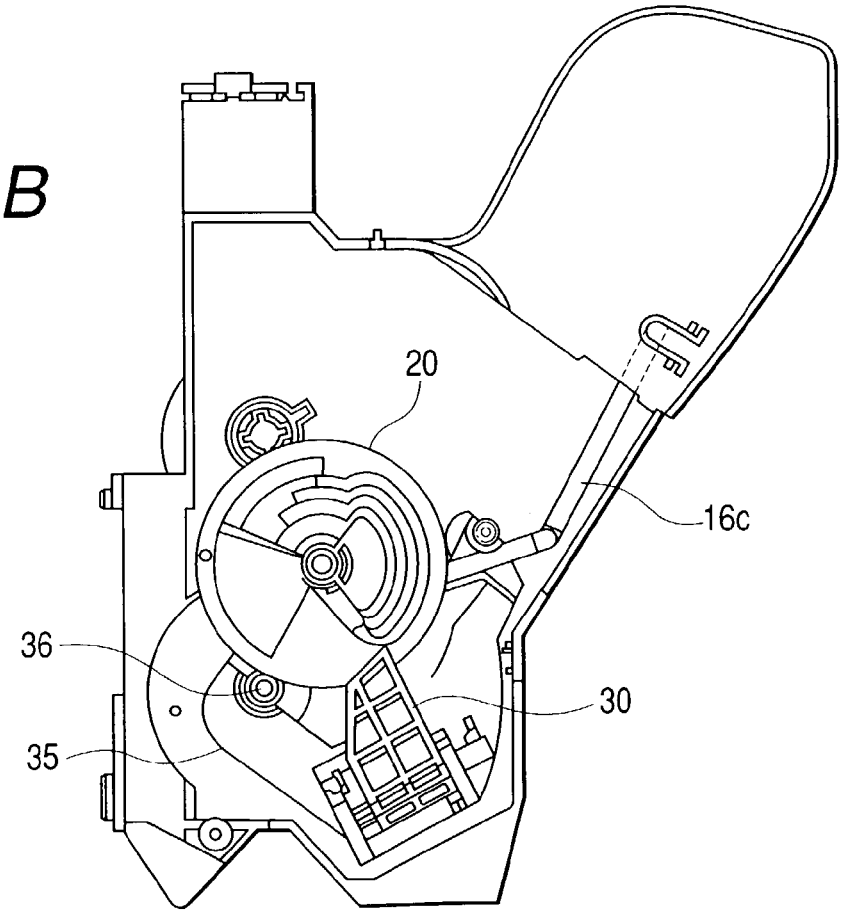

Next, as the paper feed roller 3 is further forward rotated, the cam lever 30 climbs to the outer peripheral surface of the fan-shaped cam 22*c* from the fan-shaped guide face 23*c* (FIG. 18B) and the hopper 6 is a little rotated in the direction in which it is brought away from the paper feed roller 3 and thus the paper P is placed in a state in which it is a little away from the paper feed roller 3 (FIGS. 19A and 19B). That is, the hopper release device executes the small release mode (section d in FIG. 14).

The paper feed roller 3 rotates once (360 degrees) and rotation of the paper feed roller 3 is stopped in a state in which the flat portion of the shape roughly like a letter D as the side view is opposed to the separation pad 8 for preventing a transport load from occurring on the paper P during the print operation (transport operation). In this state, a wait is made until feeding the next sheet of paper P is started (FIGS. 19A and 19B) (section e in FIG. 14). That is, if a feed job of the next and later sheets of paper P is left, the hopper release device does not execute the large release mode of placing the hopper 6 most away from the paper feed roller 3 after the termination of the paper feed operation of one sheet of paper P and executes the small release mode for placing the top sheet of paper P a little away from the paper feed roller 3 after the termination of the paper feed operation of paper R When the next sheet of paper P is fed, it is made possible for the hopper 6 to press the paper P against the paper feed roller 3 at a slight swing angle.

Figure 22A:
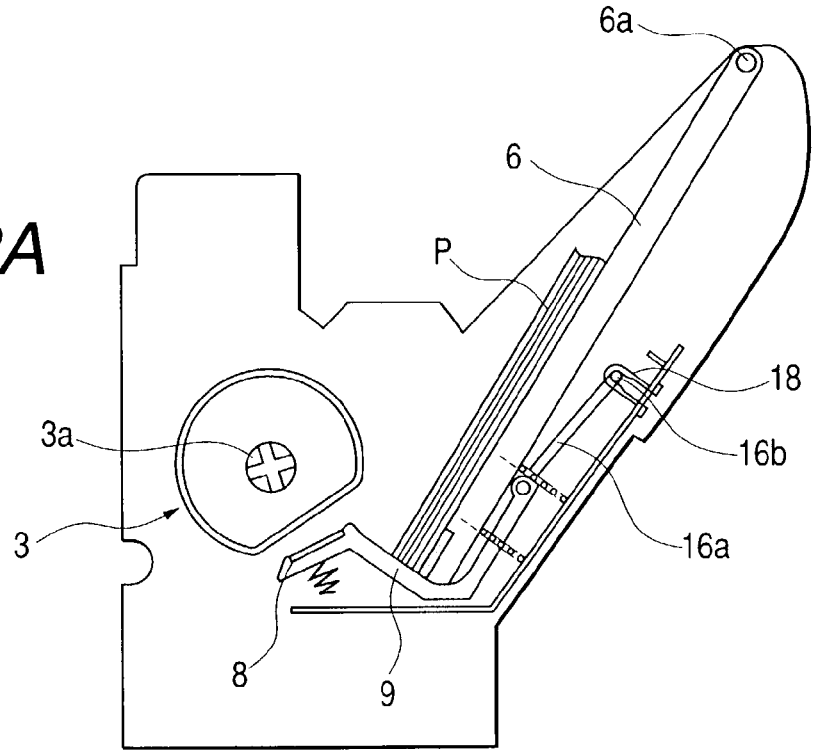
FIGS. 22A and 22B are schematic representations during the paper feed operation of the paper feeder according to the invention.
Figure 22B:
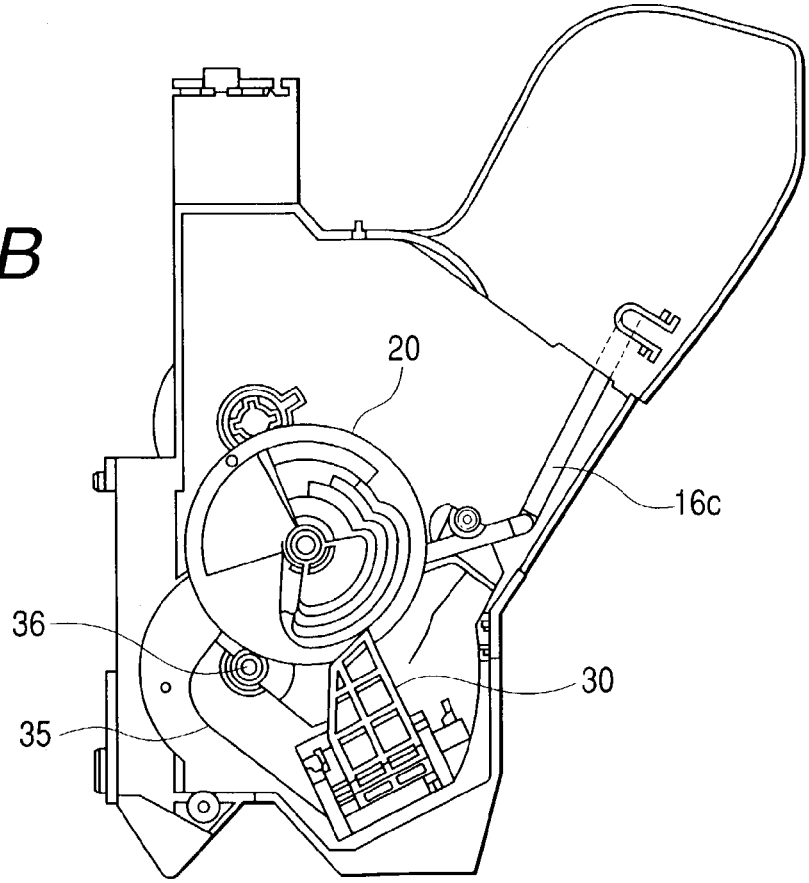

Next, if a feed job of another sheet of paper P does not exist upon completion of all print operation, the hopper release device executes the large release mode and makes a transition to a nonoperating state. More particularly, the hopper release device makes a transition to section f after the termination of section e in FIG. 14 (after the termination of the print operation). In the section f, the paper feed roller 3 is forward rotated, whereby the cam lever 30 is once detached from the fan-shaped cam 22*c* and is induced to the non-cam part 26 (FIG. 20B) and from the state, the paper feed roller 3 is reversely rotated, whereby the cam lever 30 is guided to the outer peripheral surface of the fan-shaped cam 22*a* (FIG. 21B) and the hopper 6 is rotated so that it is brought most away from the paper feed roller 3. That is, the large release mode is executed (FIGS. 22A and 22B).

Here, the paper feed roller 3 is forward rotated, whereby the cam lever 30 is once detached from the fan-shaped cam 22*c* and is induced to the non-cam part 26. However, the cam lever 30 can also be induced to the non-cam part 26 by reversely rotating the paper feed roller 3 (rotating the rotary cam 20 clockwise in the figure). In this case, the paper feed roller 3 is once rotated reversely from the state in which the cam lever 30 is on the fan-shaped cam 22*c*, whereby it is made possible to execute the large release mode.

As described above, if a feed job of feeding the next and later sheets of paper P is left after the termination of the paper feed operation of the top sheet of paper P, the hopper release device executes the small release mode, so that it is made possible to minimize the swing range (swing angle) of the hopper 6 to feed the next sheet of paper P and thus it is made possible to decrease noise occurring when the hopper 6 is swung and execute the high-speed paper feed operation (repeated paper feed).

The hopper 6 is rotated in the direction in which it is pressed against the paper feed roller 3 by the helical compression spring 7. Since the hopper 6 is rotated in the direction through the release bar 16 restrained by the cam lever holder 35, the paper P stacked on the hopper 6 does not collide with the paper feed roller 3 vigorously by the spring force of the helical compression spring 7 and thus it is made possible to prevent defective conditions such as uneven sheets of paper P and wrinkling of paper P.

By the way, referring again to FIG. 7, the tip of paper P stacked on the hopper 6 slides on the guide face 13*a* of the guide member 13 when the hopper 6 is swung, and thus if the friction coefficient between the guide face 13*a* and the tip of paper P is large, smooth paper feed operation cannot be performed if the swing range (swing angle) of the hopper 6 is minimized as described above. Therefore, a lubricant is applied to the guide face 13*a* in the embodiment, whereby the friction coefficient is made low (in the embodiment, $\mu<0.3$), so that the smooth paper feed operation can be performed reliably. However, the following control is performed in the paper feed operation sequence, whereby it is made possible to overcome the defective conditions at the paper feed operation time and provide the normal print quality more reliably:

To begin with, in FIG. 7, paper P fed by the paper feed roller 3 passes through the detector 136*a* of the paper detector 136 and then is nipped between the transport drive roller 162 and the transport driven roller 163. After the paper P is nipped between the two rollers, a given amount of start locating control is performed and print on the paper P is started. To perform the given amount of start locating control, upon reception of a passage detection signal of the paper P tip from the paper detector 136, the transport drive roller 162 may be rotated as much as predetermined phase based on the signal reception timing.

On the other hand, FIG. 14 shows the relationship between the timing at which the paper detector 136 detects the passage of the paper P tip and the timing at which the paper P tip arrives at the nip point between the transport drive roller 162 and the transport driven roller 163 and the state of the hopper 6. That is, at point I indicated by symbol I, the paper P tip passes through the detector 136*a* of the paper detector 136 and at point indicated by symbol II, the paper P tip arrives at the nip point between the transport drive roller 162 and the transport driven roller 163.

However, if the swing operation of the hopper 6 is not smoothly performed and the timing at which the top sheet of paper P is pressed against the paper feed roller 3 is delayed, it is feared that the points I and II may shift to points I' and II' shown in FIG. 14. Then, it is feared that the point at which the hopper 6 is switched from the non-release state to the small release state may be contained between the points I" and II", namely, the small release mode may be executed.

When the hopper 6 executes the small release mode, the cam lever 30 climbs from the small-diameter cam part 23 to the large-diameter cam part 22 as described above and thus at this time, a rotation load is imposed on the paper feed roller shaft 3*a* of the rotation shaft of the rotary cam 20 and accordingly the paper feed roller shaft 3*a* is twisted. If the paper feed roller shaft 3*a* is thus twisted, the feed amount of paper P is decreased accordingly.

However, when the start locating amount of paper P from the nip point between the transport drive roller 162 and the transport driven roller 163 is controlled based on the timing at which the passage detection signal of the paper P tip is received from the paper detector 136 as described above, if the timing at which the top sheet of paper P is pressed against the paper feed roller 3 is delayed and thus the feed amount of paper P is decreased as the paper feed roller shaft 3*a* is twisted between the points I' and II" as described above, the timing at which the paper P tip arrives at the nip point between the transport drive roller 162 and the transport driven roller 163 is delayed and accordingly the objective start locating amount may not be provided. This particularly becomes a problem because the swing angle of the hopper 6 reaches the maximum in the first sheet of paper P when a nonoperating job sequence is started with the top sheet of paper P pressed by the hopper 6 which is in the large release state (the paper feed unit 1 is in a nonoperating state) and executes the non-release mode from the large release state.

Then, for example, skew removal in so-called bite and ejection technique (in which the paper P tip is once bitten between the transport drive roller 162 and the transport driven roller 163 and then is ejected upstream, thereby removing skew) is performed only for the first sheet of paper P when the paper feed job sequence is started, whereby the problem of insufficient start locating amount as described above can be solved. A similar advantage can also be provided by making powerful the urging force of the urging device of the hopper 6 (in the embodiment, the helical compression spring 7) and making more reliable the rotation of the hopper 6 in the direction in which the hopper 6 is pressed against the paper feed roller 3.

FIG. 3 shows, in a recording apparatus comprising a paper feeder wherein a plurality of single sheets of paper can be set, a paper delivery device for transporting paper fed from the paper feeder to a recorder, and a control unit for controlling operation of the paper feeder and the paper delivery device, the control unit which comprises a skew removal execution mode of only the first sheet of paper where the paper tip is bitten into a paper delivery roller forming a part of the paper delivery device and then the paper delivery roller is reversely rotated for ejecting the paper tip for the first sheet of paper at the start of recording and then forward rotating the paper delivery roller for delivering the sheet of paper whose skew is removed to the recorder and delivering the second and later sheets of paper to a record area without executing the skew removal. The control unit comprises two or more of the paper feed modes (skew removal execution mode of the first sheet of paper only, skew removal mode, skew removal suppression mode, and speed change mode) in the recording apparatus according to any one of claims 1 to 5. The control unit outputs a control signal to the drive motor 169 for executing each mode.

As described above, according to the invention, noise occurring when the hopper is swung can be decreased, high-speed paper feed operation can be performed, and throughput can be enhanced.

Although the invention has been described in its preferred form with a certain degree of particularity, obviously many changes and variations are possible therein. It is therefore to be understood that the present invention may be practiced than as specifically described herein without departing from scope and the sprit thereof.

What is claimed is:

1. A recording apparatus comprising:

a paper feeder configured to set a plurality of single sheets of paper therein;

a paper delivery device having a paper delivery roller for transporting a sheet of paper fed from said paper feeder to a recorder; and a control unit for controlling operation of said paper feeder and said paper delivery device;

wherein said paper feeder and paper delivery device are configured to conduct a skew removal that a paper tip of a sheet of paper fed by said paper feeder is once bitten into the paper delivery roller and then ejected therefrom by reversely rotating said paper delivery roller before delivering the sheet of paper to the recorder by forwardly rotating the paper delivery roller; and said control unit comprises a skew removal mode where the skew removal is executed to a sheet of paper whose margin dimension in data to execute recording is smaller than a reference value and a skew removal suppression mode where a sheet of paper whose margin dimension is larger than the reference value is delivered to the recorder without executing the skew removal.

2. A recording apparatus comprising:

a paper feeder configured to set a plurality of single sheets of paper therein;

a paper delivery device having a paper delivery roller for transporting a sheet of paper fed from said paper feeder to a recorder; and a control unit for controlling operation of said paper feeder and said paper delivery device;

wherein said paper feeder and paper delivery device are configured to conduct a skew removal that a paper tip of a sheet of paper fed by said paper feeder is once bitten into the paper delivery roller and then ejected therefrom by reversely rotating said paper delivery roller before delivering the sheet of paper to the recorder by forwardly rotating the paper delivery roller; and said control unit comprises a skew removal mode where the skew removal is executed to a sheet of paper whose image data amount in data to execute recording is larger than a reference value and a skew removal suppression mode where a sheet of paper whose image data amount is smaller than the reference value is delivered to the recorder without executing the skew removal.

3. A recording apparatus comprising:

a paper feeder configured to set a plurality of single sheets of paper therein, including a paper feed roller for feeding one of the sheets of paper by rotating, a hopper for pushing up and pressing the sheets of paper against the paper feed roller, an urging device located opposite to the paper feed roller with respect to the hopper for urging the hopper toward the feed roller and a hopper release device for moving the hopper apart from the paper feed roller while resisting the urging device, said hopper release device being connected to the hopper;

a paper delivery device having a paper delivery roller for transporting a sheet of paper fed from said paper feeder to a recorder; and a control unit for controlling operation of said paper feeder and said paper delivery device;

wherein the hopper is configured to push up the first sheet of paper at the start of recording operation at a first stroke and to push up the later sheets of paper at a second stroke which is smaller than the first stroke; and wherein said control unit comprises a speed change mode where a first hopper pushing-up speed when the first stroke is applied is set lower than a second pushing-up speed when the second stroke is applied.

4. A recording apparatus comprising:

a paper feeder configured to set a plurality of single sheets of paper therein;

a paper delivery device for transporting paper fed from said paper feeder to a recorder; and a control unit for controlling operation of said paper feeder and said paper delivery device;

wherein said control unit comprises two or more of the following modes in the recording apparatus:

a first mode for a paper feed job sequence including a plurality of the sheets of paper, wherein in accordance with the skew removal execution mode, a skew removal is executed only to a paper tip of a first sheet of paper which is firstly fed by the paper feeder at a start of recording operation of the apparatus and later sheets of paper are delivered to the recorder without executing the skew removal, a second mode where the skew removal is executed to a sheet of paper whose margin dimension in data to execute recording is smaller than a reference value and a skew removal suppression mode where a sheet of paper whose margin dimension is larger than the reference value is delivered to the recorder without executing the skew removal;

a third mode where the skew removal is executed to a sheet of paper whose image data amount in data to execute recording is larger than a reference value and the skew removal suppression mode where a sheet of paper whose image data amount is smaller than the reference value is delivered to the recorder without executing the skew removal; and a fourth speed change mode where a first hopper pushing-up speed is set lower than a second pushing-up speed when the second stroke is applied, the hopper being configured to push up the first sheet of paper at the start of recording operation at a first stroke and to push up the later sheets of paper at a second stroke which is smaller than the first stroke, wherein said second stoke is variable in accordance with an amount of the plurality of single sheets of paper in the a paper feeder;

wherein said skew removal in which a paper tip of a sheet of paper fed from said paper feeder is once bitten into the paper delivery roller and then ejected therefrom by reversely rotating said paper delivery roller before delivering the sheet of paper to the recorder by forwardly rotating the paper delivery roller.

* * * * *